US007945181B2

(12) United States Patent
Okada

(10) Patent No.: US 7,945,181 B2
(45) Date of Patent: May 17, 2011

(54) FIXING DEVICE, IMAGE FORMING APPARATUS, AND FIXING-DEVICE CONTROL METHOD

(75) Inventor: Norikazu Okada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 99 days.

(21) Appl. No.: 12/382,501

(22) Filed: Mar. 18, 2009

(65) Prior Publication Data

US 2009/0238595 A1 Sep. 24, 2009

(30) Foreign Application Priority Data

Mar. 18, 2008 (JP) ..... 2008-070449
Jan. 27, 2009 (JP) ..... 2009-015895

(51) Int. Cl.
*G03G 15/20* (2006.01)

(52) U.S. Cl. ..... 399/69; 219/216; 399/70; 430/124.1

(58) Field of Classification Search ..... 399/69, 399/70, 82, 67; 219/216, 255, 490, 494; 347/156; 430/124.1
See application file for complete search history.

(56) References Cited

U.S. PATENT DOCUMENTS

2005/0276625 A1* 12/2005 Cho ..... 399/69
2006/0198646 A1* 9/2006 Funabiki et al. ..... 399/69 X
2008/0069584 A1* 3/2008 Sanada et al. ..... 399/88
2008/0260408 A1* 10/2008 Takagi et al. ..... 399/69
2008/0292348 A1* 11/2008 Furuyama ..... 399/69
2009/0074442 A1* 3/2009 Sano et al. ..... 399/69

FOREIGN PATENT DOCUMENTS

JP 2003-217793 7/2003

* cited by examiner

*Primary Examiner* — Sophia S Chen
(74) *Attorney, Agent, or Firm* — Harness, Dickey & Pierce, P.L.C.

(57) ABSTRACT

In a fixing device, a fixing unit fixes a toner image transferred onto a recording medium by a heating target unit heated by a plurality of heating units each of which is grouped as a first heating unit to which power is selectively supplied or a second heating unit to which power is supplied in priority to the first heating unit, and a supply control unit supplies power to a heating unit grouped as the second heating unit and selectively supplies power to a heating unit grouped as the first heating unit, among the heating units that heat the heating target unit of which detected temperature by a detecting unit is lower than a target temperature.

15 Claims, 21 Drawing Sheets

FIG. 4

| OPERATION MODE | FIRST HEATING UNIT | SECOND HEATING UNIT | THIRD HEATING UNIT |
|---|---|---|---|
| (1) WARMING-UP | FIRST PRIORITY | FIRST PRIORITY | FIRST PRIORITY |
| (2) RETURNING FROM POWER SAVING MODE | FIRST PRIORITY | FIRST PRIORITY | FIRST PRIORITY |
| (3) COPYING (OPERATIVE) | FIRST PRIORITY | FIRST PRIORITY | FIRST PRIORITY |
| (4) STANDBY | FIRST PRIORITY | SECOND PRIORITY | SECOND PRIORITY |
| (5) POWER SAVING MODE | SECOND PRIORITY | SECOND PRIORITY | SECOND PRIORITY |

FIG. 5

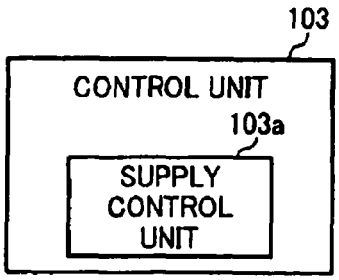

FIXING DEVICE, IMAGE FORMING APPARATUS, AND FIXING-DEVICE CONTROL METHOD

CROSS-REFERENCE TO RELATED APPLICATIONS

The present application claims priority to and incorporates by reference the entire contents of Japanese priority document 2008-070449 filed in Japan on Mar. 18, 2008 and Japanese priority document 2009-015895 filed in Japan on Jan. 27, 2009.

BACKGROUND OF THE INVENTION

1. Field of the Invention

The present invention relates to a technology for fixing a toner image on a recording medium in an image forming apparatus.

2. Description of the Related Art

In recent years, there is an increasing demand for a high-speed process of an image forming apparatus, such as a printer, a copier, a facsimile machine, that forms an image using an electrophotographic method. For example, in an image forming apparatus including a heat-roller-type fixing device that applies heat and pressure onto a recording medium such as a sheet of paper or film on which a toner image is formed, a plurality of heating units is provided in the fixing device or a large amount of power is supplied to each heating unit, thereby meeting the demand for high-speed image formation.

An increase of the speed of an image forming apparatus is increased by supplying a larger amount of power or by providing a plurality of heating units increases the required power, resulting in a possible voltage fluctuation (hereinafter, "flicker") of the image forming apparatus or the fixing device. Especially when the image forming apparatus or the fixing device is switched from the OFF-state to the ON-state, an inrush current flows, which is several times higher than a current in a steady state, and the flicker gets worse. In an image forming apparatus, generally, in an operating mode in which an operation, such as copying and printing, is performed and in a standby mode in which the apparatus is ready for taking an operation, the flicker is controlled. However, in a place such as a typical office, an image forming apparatus remains for a longer time in the standby mode than in the operating mode. Therefore, the flicker needs to be controlled more strictly in the standby mode. The flicker may cause influence on power supply to peripheral devices to which power is supplied from a common power source.

Japanese Patent Application Laid-open No. 2003-217793 discloses a heater control device that, when a plurality of heating units is switched on, applies current to the heating units not simultaneously but with a time lag to independently soft start and switch on the heating units, and that, when the heating units are switched off, soft stops and switches off the heating units with a time lag.

In the heater control device disclosed in Japanese Patent Application Laid-open No. 2003-217793, however, even if the timing at which power supply to each of the heating units starts is shifted sequentially, the heating units tend to repeat a cycle of switching on and off each heating unit in the same cycle. Moreover, because the heating units are thermally stable in the standby mode in which the heat is not transferred to a recording medium from the fixing device, a period during which the heating units are switched off gets longer. Therefore, at the time of switching on the heating units again, the inrush current may be higher than the current in the operating mode. As a result, it is difficult to suppress the flicker. In an image forming apparatus in which the amount of power to be supplied per each heating unit is large, the flicker gets even worse. In the standby mode in which the heat is not transferred to a recording medium from the fixing device, the flicker is required to be suppressed more strictly, as described above. Therefore, the flicker caused by the heating units repeating the cycle of switching on and off is required to be suppressed more efficiently.

SUMMARY OF THE INVENTION

It is an object of the present invention to at least partially solve the problems in the conventional technology.

According to one aspect of the present invention, there is provided a fixing device including a fixing unit that fixes a toner image transferred onto a recording medium by a heating target unit heated by a plurality of heating units each of which is grouped as a first heating unit to which power is selectively supplied or a second heating unit to which power is supplied in priority to the first heating unit; a detecting unit that is provided to each of the heating units, and detects a temperature of the heating target unit heated by the heating units; and a supply control unit that supplies power to a heating unit grouped as the second heating unit and selectively supplies power to a heating unit grouped as the first heating unit, among the heating units that heat the heating target unit of which detected temperature is lower than a target temperature.

Furthermore, according to another aspect of the present invention, there is provided an image forming apparatus including a fixing unit that fixes a toner image transferred onto a recording medium by a heating target unit heated by a plurality of heating units each of which is grouped as a first heating unit to which power is selectively supplied or a second heating unit to which power is supplied in priority to the first heating unit; a detecting unit that is provided to each of the heating units, and detects a temperature of the heating target unit heated by the heating units; and a supply control unit that supplies power to a heating unit grouped as the second heating unit and selectively supplies power to a heating unit grouped as the first heating unit, among the heating units that heat the heating target unit of which detected temperature is lower than a target temperature.

Moreover, according to still another aspect of the present invention, there is provided a method of controlling a fixing device. The method includes fixing a toner image transferred onto a recording medium by a heating target unit heated by a plurality of heating units each of which is grouped as a first heating unit to which power is selectively supplied or a second heating unit to which power is supplied in priority to the first heating unit; detecting a temperature of the heating target unit heated by the heating units; and supplying power to a heating unit grouped as the second heating unit and selectively supplies power to a heating unit grouped as the first heating unit, among the heating units that heat the heating target unit of which detected temperature is lower than a target temperature.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a table an example in which each heating unit of the fixing device is grouped;

FIG. 5 is a schematic diagram of a functional configuration of a control unit that performs processes for supplying power to a heating unit of the fixing device when a flicker priority mode is set;

DETAILED DESCRIPTION OF THE PREFERRED EMBODIMENTS

Exemplary embodiments of a fixing device, an image forming apparatus, and a control method of a fixing device according to the present invention are described in detail below with reference to the accompanying drawings. Examples are described of applying an image forming apparatus according to the present invention to a multifunction peripheral (MFP). The present invention is, however, not limited thereto, and can also be applied to a copying machine, a printer, and a facsimile, for example.

Figure 1:
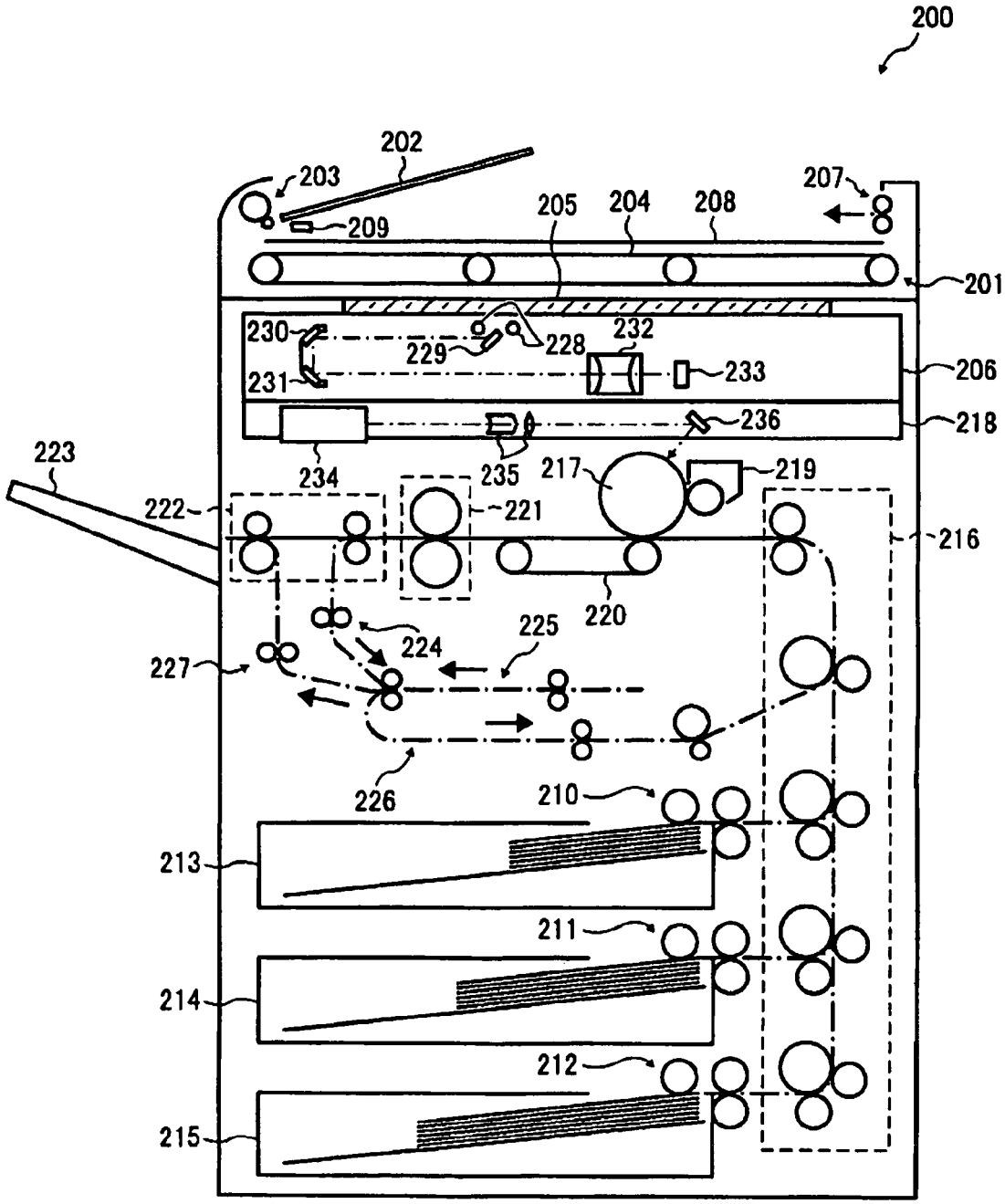
FIG. 1 is a schematic diagram for explaining an example a multifunction product (MFP) according to a first embodiment of the present invention.

FIG. 1 is a schematic diagram for explaining an example of an MFP 200 according to a first embodiment of the present invention. The MFP 200 is an image forming apparatus such as a digital copying machine. The MFP 200 has a copying function as well as functions other than the copying function such as a printing function and a facsimile function. By operating an application switching key (not shown) in an operation unit, a copying, a printing, and a facsimile functions can be switched sequentially, and thus, each of the functions can be selected. Therefore, the MFP 200 is in a copying mode when the copying function is selected, in a printing mode when the printing function is selected, and in a facsimile mode when the facsimile function is selected.

In the MFP 200, an original tray (also referred to as an "original table") 202 is provided in an automatic paper feeder (also referred to as an "automatic document feeder" (ADF)) 201. A set of originals is placed on the original tray 202 so that the surface of each original faces upward. When a start key on the operation unit (not shown) is pressed in the copying mode, the originals are sequentially fed to a predetermined position on an exposure glass 205 by a feeding roller 203 and a feeding belt 204, starting from the original at the bottom of the originals. The ADF 201 has an incrementing function that increments the number of originals each time a piece of the originals is fed thereto. An image reading device (also referred to as a "scanner" or a "reading unit") 206 scans images on each of the originals set on the exposure glass 205. When the image reading device 206 completes the scanning, the feeding belt 204 and a discharging roller 207 discharge the originals on a discharge table 208.

Each time the image reading device 206 completes scanning of a piece of the originals, an original set detector (also referred to as an "original set sensor") 209 detects if the next original is present on the original tray 202. If the original set detector 209 detects that the next original is present on the original tray 202, the feeding roller 203 and the feeding belt 204 feed the original at the bottom of the originals on the original tray 202 to the predetermined position on the exposure glass 205 similarly to the previous original, and perform the same operation described above. The feeding roller 203, the feeding belt 204, and the discharging roller 207 are driven by a conveying motor (not shown).

When a first feeder 210, a second feeder 211, or a third feeder 212 is selected, the first feeder 210, the second feeder 211, or the third feeder 212 feeds a recording medium such as a sheet of paper stored in a first feeding tray 213, a second feeding tray 214, or a third feeding tray 215. A vertical conveying unit 216 conveys a sheet to a position at which the sheet is in contact with a photosensitive element 217. For example, a photosensitive drum is used as the photosensitive element 217. A main motor (not shown) rotates the photosensitive element 217.

An image processing device (not shown) performs predetermined image processing on image data (image information) input by image scanning of an original performed by the image reading device 206. Then, the image data are conveyed to a writing unit 218 constituting an image printing unit (printer), as they are or after being stored in an image memory (not shown) constituting an image storage unit. The writing unit 218 converts the image data into optical information, and then, a charging unit (not shown) uniformly charges the surface of the photosensitive element 217. The surface of thereof is exposed by the optical information from the writing unit 218. As a result, an electrostatic latent image is formed on the surface of the photosensitive element 217. A developing device (also referred to as a "developing unit") 219 develops the electrostatic latent image formed on the photosensitive element 217. Thus, a toner image is formed thereon.

A printer engine that is an image forming unit that performs image forming operation for forming an image on a sheet based on image data employing an electrophotographic method includes the photosensitive element 217, the charging unit, the writing unit 218, the developing device 219, and other known peripheral devices (not shown) around the photosensitive element 217. A conveying belt 220 also serves as a sheet conveying unit and a transferring unit. A power supply applies a transfer bias to the conveying belt 220, and then, the conveying belt 220 conveys the sheet from the vertical conveying unit 216 in the same speed as the photosensitive element 217, thereby transferring the toner image formed on the photosensitive element 217 to the sheet. A fixing device 221 fixes the toner image on the sheet, and a discharging unit 222 discharges the sheet to a discharging tray 223. The image forming unit that forms an image on a sheet based on image data includes the photosensitive element 217, the charging unit, the writing unit 218, the developing device 219, and the transfer unit.

Operation for copying an image on a single side of a sheet in a normal mode is described above. On the other hand, when images are copied on the both sides of a sheet in a double-sided mode, a sheet that is fed by one of the first to the third feeding trays 213 to 215 and with an image formed on a surface thereof is conveyed to the side of a double-sided sheet conveying path 224, not to the side of the discharging tray 223, by the discharging unit 222. A reversing unit 225 switches back the sheet, thereby reversing the sheet upside down, and then, the sheet is conveyed to a double-sided sheet conveying unit 226.

The double-sided sheet conveying unit 226 conveys the sheet conveyed to the double-sided sheet conveying unit 226 to the vertical conveying unit 216. The vertical conveying unit 216 conveys the sheet to a position at which the sheet is in contact with the photosensitive element 217. Then, a toner image formed on the photosensitive element 217 is transferred onto the back side of the sheet, and the fixing device 221 fixes the toner image thereon. Thus, an image is copied on the both sides of the sheet. The discharging unit 222 discharges the sheet with an image copied on the both sides to the discharging tray 223. For discharging the sheet after reversing the surface thereof, the sheet that is switched back by the reversing unit 225 and that is reversed upside down is not conveyed to the double-sided sheet conveying unit 226, but is discharged to the discharging tray 223 via a reversing and discharging path 227 by the discharging unit 222.

In the printing mode, however, image data is input to the writing unit 218, not from the image processing device, but from an external device, and then, an image is formed on the sheet similarly to the above description. In the facsimile mode, a facsimile transmitting and receiving unit (not shown) transmits image data from the image reading device 206 to a receiver. The facsimile transmitting and receiving unit also receives image data from a sender, and the image data, instead of image data from the image processing device, is input to the writing unit 218. Thus, an image is formed on the sheet similarly to the above description.

The MFP 200 also includes a large capacity tray (LCT) (not shown), a post processing device (not shown) that performs operations such as sorting, perforating, and stapling, and an operating unit having various keys and a display such as a liquid crystal display (LCD) used for performing settings of a mode for reading an image on an original, a magnifying power for copying, a feeding tray, and post processing performed by the post processing device, and for displaying various information for an operator.

The image reading device 206 includes the exposure glass 205 and an optical scanning system. The optical scanning system includes components such as an exposure lamp 228, a first mirror 229, a lens 232, and a CCD image sensor 233. The exposure lamp 228 and the first mirror 229 are fixed to a first carriage (not shown), and a second mirror 230 and a third mirror 231 are also similarly fixed to a second carriage (not shown). When the image reading device 206 reads an image on an original, the first and the second carriages move in a relative speed of two to one so that the light path length does not change, thereby mechanically scanning the image. A driving unit including a scanner driving motor (not shown) drives the optical scanning system.

The image reading device 206 reads an image on an original optically, and then, converts the image into an electrical signal (thus, the image reading device 206 reads image data on the original). The exposure lamp 228 in the optical scanning system exposes the image surface of the original, and a reflected light image from the image surface forms an image on the light receiving surface of the CCD image sensor 233 via the first mirror 229, the second mirror 230, the third mirror 231, and the lens 232. The CCD image sensor 233 converts the image into an electrical signal. Here, by moving the lens 232 and the CCD image sensor 233 in the horizontal direction in FIG. 1, an image reading magnifying power can be changed in the feeding direction of the original. That is, to set an image reading magnifying power to be a predetermined value, the lens 232 and the CCD image sensor 233 must be at a particular position each in the horizontal direction.

The writing unit 218 includes a laser output unit 234, an imaging lens 235, and a mirror 236. A laser diode that is a laser light source and a polygon mirror that is rotated at a high speed by a motor are provided within the laser output unit 234. The laser output unit 234 emits a laser beam (a laser light) and the laser beam is deflected by the polygon mirror rotating at a constant speed. Then, the laser beam passes through the imaging lens 235 and the mirror 236 turns back the laser beam. Thus, the laser beam is collected on the charged surface of the photosensitive element 217, thereby forming an image thereon.

The laser beam deflected by the polygon mirror scans the photosensitive element 217 in the direction perpendicular to the rotating direction of the photosensitive element 217 (i.e., the main-scanning direction), and thus, image data output by the image processing device is written thereon per line. By repeating main scanning in a predetermined cycle corresponding to the rotational speed and the scanning density (recording density) of the photosensitive element 217, an electrostatic latent image is formed on the charged surface of the photosensitive element 217.

Figure 2:
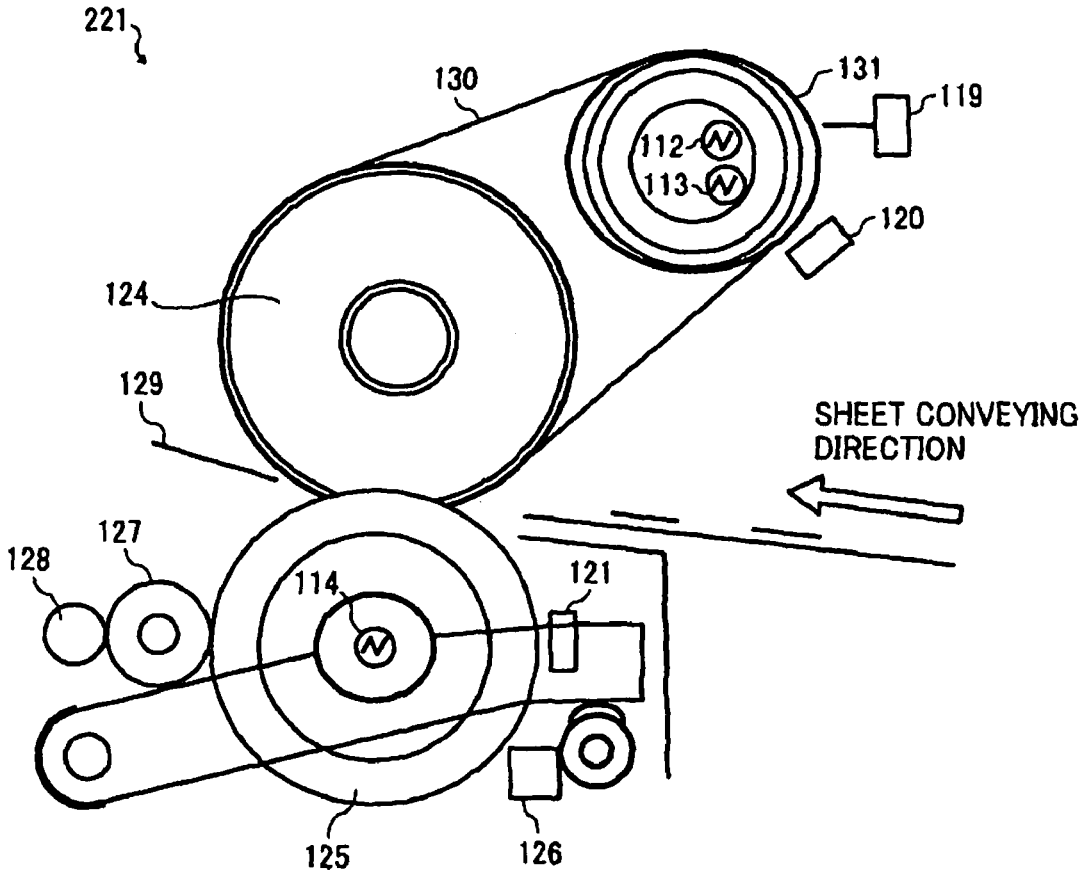
FIG. 2 is a schematic diagram of a configuration example of a fixing device of the MFP shown in FIG. 1.

A configuration of the fixing device 221 shown in FIG. 1 is described below in detail. FIG. 2 is a schematic diagram of a configuration example of the fixing device 221 shown in FIG. 1. As shown in FIG. 2, the fixing device 221 includes a fixing roller 124 serving as a fixing unit, a fixing belt 130 supported by the fixing roller 124, a heating roller 131 heating the fixing belt 130, and a pressing roller 125. The pressing roller 125 is a pressing member made from elastic material such as silicon rubber. A pressing member (not shown) presses the pressing roller 125 against the fixing roller 124 with a certain amount of pressing force.

A depressurization sensor 126 measures a pressure with which the pressing unit presses the pressing roller 125 against the fixing roller 124. The pressing unit presses the pressing roller 125 against the fixing roller 124 according to the pressure measured by the depressurization sensor 126. An oil applying roller 127 applies a small amount of silicon oil on the pressing roller 125. Thus, the oil applying roller 127 collects the toner attached to the pressing roller 125. Application of silicon oil increases smoothness of the surface of the sheet, thereby preventing the sheet from sticking to the pressing roller 125 and facilitating a separating plate 129 to separate the sheet from the rollers. A cleaning roller 128 collects the toner collected from the pressing roller 125 by the oil applying roller 127 from the oil applying roller 127.

The fixing device 221 includes a plurality of first to third heating units (HUs) 112 to 114. The fixing device 221 fixes the toner image transferred onto the sheet with a heating target member (for example, the heating roller 131, the fixing roller 124, or the pressing roller 125) heated by the first to third heating units 112 to 114. For example, the first heating unit 112 and the second heating unit 113 are arranged inside the heating roller 131, and heat the heating roller 131 from inside. The third heating unit 114 is arranged inside the pressing roller 125, and heats the pressing roller 125 serving as a pressing member from inside.

A drive mechanism (not shown) rotates the fixing roller 124 and the pressing roller 125. A first temperature detecting circuit 119 such as a thermistor comes into contact with the surface of the heating roller 131 heated by the first heating unit 112, and detects a surface temperature (fixing temperature) of the heating roller 131. Similarly, a second temperature detecting circuit 120 such as a thermistor comes into contact with the surface of the heating roller 131 heated by the second heating unit 113, and detects a surface temperature (fixing temperature) of the heating roller 131. Similarly, a third temperature detecting circuit 121 such as a thermistor also comes into contact with the surface of the pressing roller 125 heated by the third heating unit 114, and detects a surface temperature of the pressing roller 125. When a recording medium such as a sheet carrying a toner image thereon passes through a nip portion between the fixing roller 124 and the pressing roller 125, the toner image is fixed by heat and pressure applied by the fixing roller 124 and the pressing roller 125.

Figure 3:
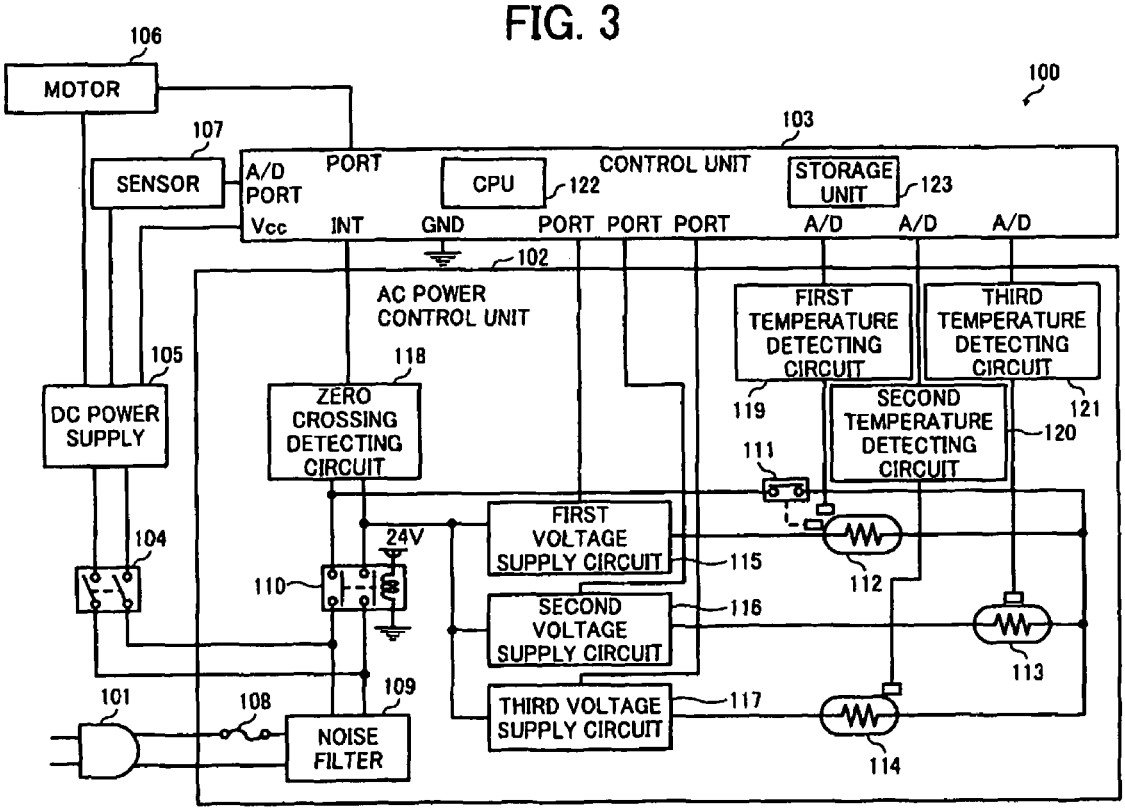
FIG. 3 is a block diagram of a control system mainly for the fixing device of the MFP shown in FIG. 1.

FIG. 3 is a block diagram of a control system mainly for the fixing device 221. As shown in FIG. 3, a control system 100 includes a commercial power supply 101, an alternating current (AC) power control unit 102, a control unit 103, a main power supply switch (SW) 104, a direct current (DC) power supply 105, a motor 106 (e.g., motor, solenoid (SOL), or clock (CL)), and a sensor 107 (e.g., sensor, or switch (SW)). The AC power control unit 102 includes an overcurrent protection element 108, a noise filter 109, a relay 110, a thermostat 111, the first heating unit 112, the second heating unit 113, the third heating unit 114, a first voltage supply circuit 115, a second voltage supply circuit 116, a third voltage supply circuit 117, a zero crossing detecting circuit 118, the first temperature detecting circuit 119, the second temperature detecting circuit 120, and the third temperature detecting circuit 121. The control unit 103 includes a central processing unit (CPU) 122 and a storage unit 123.

The commercial power supply 101 supplies power to the various devices in the control system 100 via the overcurrent protection element 108 that is a fuse and the noise filter 109. The main power supply SW 104 is a switch that switches on/off of the MFP 200 on which the fixing device 221 is mounted. When the main power supply SW 104 is turned on, power is supplied to the DC power supply 105, and then, to the control unit 103, the motor 106, and the sensor 107 via the DC power supply 105.

The DC power supply 105 is a device such as an AC/DC converter, and converts an AC output supplied by the main power supply SW 104 into a DC power. The DC power supply 105 supplies the DC power thus converted to the control unit 103, the motor 106, and the sensor 107.

Power supplied by the commercial power supply 101 via the overcurrent protection element 108 and the noise filter 109 is supplied to the first to third voltage supply circuits 115 to 117 via the relay 110 that is a switching device.

A voltage (24 V) is applied to the both ends of a coil provided in the relay 110 according to a power supply signal (not shown) from the control unit 103. Thus, the relay 110 is opened and closed accordingly. In the present embodiment, a voltage of 24 V is applied to the both ends of the coil provided in the relay 110. The present invention, however, is not limited thereto. A voltage of, for example, 12 V or 5 V is applied thereto according to the specification of the relay 110.

More specifically, the relay 110 is configured to be closed when the main power supply SW 104 is turned on and the DC power supply 105 outputs a constant voltage. For example, the main power supply SW 104 is turned off and the DC power supply 105 stops supplying a constant voltage, if a door is opened that is opened when a sheet is jammed or when consumables such as a toner cartridge are exchanged or if some error occurs in the MFP 200. Then, voltage is excited in the coil provided in the relay 110, and the relay 110 stops supplying power to the various devices in the AC power control unit 102.

The first to third voltage supply circuits 115 to 117 supply power supplied from the commercial power supply 101 to the first to third heating units 112 to 114 under the control by the control unit 103, thereby heating the first to third heating units 112 to 114. In the present embodiment, the first to third voltage supply circuits 115 to 117 are triacs (bidirectional thyristors), and supply power to the first to third heating units 112 to 114 according to a power supply signal from the control unit 103. Here, the power supply signal is a signal that switches on/off off power supply from the first to third voltage supply circuits 115 to 117.

The first to third voltage supply circuits 115 to 117 supply power to the first to third heating units 112 to 114, and thus, the first to third heating units 112 to 114 generate heat, thereby heating the heating target members (the heating roller 131 and the pressing roller 125). More specifically, the first to third heating units 112 to 114 are halogen heaters employing material such as tungsten as filaments (heat generating part), and a heat generating area of the filament of each heater is restricted in the shaft direction of each of the rollers that are heated by the heating units.

The first to third heating units 112 to 114 are arranged inside the heating roller 131 and the pressing roller 125 as shown in FIG. 2, and generate heat according to power supplied by the first to third voltage supply circuits 115 to 117, thereby heating the heating roller 131 and the pressing roller 125 from within.

Each of the first to third heating units 112 to 114 is grouped as a second-priority heating unit (a first heating unit) or as a first-priority heating unit (a second heating unit). Here, the first heating unit is a heating unit to which power is selectively supplied, and the second heating unit is a heating unit to which power is supplied in priority to the second-priority heating unit. In the present embodiment, the storage unit 123 that is described later in detail of the control unit 103 stores therein a table in which each of the first to third heating units 112 to 114 is grouped as the first-priority heating unit or as the second-priority heating unit.

FIG. 4 is a table as an example in which each heating unit is grouped. As shown in FIG. 4, each heating unit is differently grouped as the first or the second-priority heating unit according to the operation modes of the MFP 200 ((1) warming up, (2) returning from a power saving mode, (3) copying (i.e., the MFP 200 is operative), (4) standby, and (5) power saving mode). Here, (1) warming up is when the main power supply SW 104 of the MFP 200 is turned on. (2) returning from the power saving mode is when the MFP 200 is returned from (5) power saving mode that is described later in detail. (3) copying (i.e., the MFP 200 is operative) is when the MFP 200 performs main operations of thereof such as copying and printing. (4) standby is when the MFP 200 is in a standby state in which the MFP 200 can instantly start operations such as copying and printing. (5) power saving mode is a state in which less power is supplied to the fixing device 221 than in standby.

More specifically, the first heating unit 112 is grouped as the second-priority heating unit in (5) power saving mode. That is, power is selectively supplied to the first heating unit 112 in (5) power saving mode. The first heating unit 112 is grouped as the first-priority heating unit in (1) when the main power supply of the MFP 200 is turned on (warming up), (2) returning from the power saving mode, (3) printing or copying, that is, the MFP 200 performs main functions thereof, and (4) standby for printing or copying. That is, power is supplied to the first heating unit 112 in priority to a heating unit grouped as the second-priority heating unit in (1) to (4). Therefore, in all the operation modes except (5) power saving mode, power is supplied to the first heating unit 112 in priority to a heating unit grouped as the second-priority heating unit, as long as a temperature of the heating target member (the heating roller 131) is lower than a target temperature as a standard. In (5) power saving mode, power is selectively supplied to the first heating unit 112 as long as a temperature of the heating target member (the heating roller 131) is lower than a target temperature as a standard.

Here, the target temperature (maintaining temperature) is a temperature at which poor fixing of a toner image on a recording medium is surely to be prevented. In the present embodiment, all the heating target members (the heating roller 131 and the pressing roller 125) are maintained at the same temperature. In the present embodiment, target temperatures of the heating roller 131 and the pressing roller 125 that are heating target members are maintained at the same temperature. The present invention is, however, not limited thereto. It is applicable that temperatures of the heating roller 131 and the pressing roller 125 are maintained at different temperatures each.

The second heating unit 113 is grouped as the second-priority heating unit in (4) standby for printing or copying and (5) power saving mode. That is, power is selectively supplied to the second heating unit 113 in (4) and (5). The second heating unit 113 is grouped as the first-priority heating unit in (1) warming-up, (2) returning from the power saving mode, and (3) printing and copying. That is, power is supplied to the second heating unit 113 in priority to a heating unit grouped as the second-priority heating unit in (1) to (3). Therefore, in all the operation modes except (4) standby for printing or copying or (5) power saving mode, power is supplied to the second heating unit 113 in priority to a heating unit grouped as the second-priority heating unit, as long as a temperature of the heating target member (the heating roller 131) is lower than the target temperature as a standard. In (4) standby for printing or copying and (5) power saving mode, power is selectively supplied to the second heating unit 113 as long as a temperature of the heating target member (the heating roller 131) is lower than the target temperature as a standard.

In (4) standby for printing or copying and (5) power saving mode, the third heating unit 114 is grouped as the second-priority heating unit. That is, power is selectively supplied to the third heating unit 114 in (4) and (5). Similarly to the second heating unit 113, in (1) warming-up, (2) returning from the power saving mode, and (3) printing or copying, the third heating unit 114 is grouped as the first-priority heating unit. That is, power is supplied to the third heating unit 114 in priority to a heating unit grouped as the second-priority heating unit in (1) to (3). Therefore, in all the operation modes except (4) standby for printing or copying or (5) power saving mode, power is supplied to the third heating unit 114 in priority to a heating unit grouped as the second-priority heating unit, as long as a temperature of the heating target member (the pressing roller 125) is lower than the target temperature as a standard. In (4) standby for printing or copying or (5) power saving mode, power is selectively supplied to the third heating unit 114 as long as a temperature of the heating target member (the pressing roller 125) is lower than the target temperature as a standard.

The first to third temperature detecting circuits 119 to 121 are provided to the first to third heating units 112 to 114, respectively, and detect temperatures of the heating target members (the heating roller 131 and the pressing roller 125) heated by the first to third heating units 112 to 114. In the present embodiment, the first to third temperature detecting circuits 119 to 121 are mounted on positions corresponding to heat generating areas of the first to third heating units 112 to 114, respectively, near the surface of the heating target members, and output the surface temperatures detected at the positions corresponding to the heat generating areas of the first to third heating units 112 to 114 to the control unit 103.

The thermostat 111 that is a bimetallic thermostat or a temperature fuse is a thermal protection device connected in series to the first to third heating units 112 to 114. When a temperature of devices such as the fixing roller (the heating target member) 124 included in the fixing device 221 reaches a melting temperature thereof, the thermostat 111 releases a switch in the thermostat 111 and stops power supply from the commercial power supply 101 to the first to third heating units 112 to 114. In the present embodiment, in the thermostat 111, a type of thermostat is employed that maintains the released state even after the temperature drops once the switch is released.

The zero crossing detecting circuit 118 detects a timing at which a phase of an alternating voltage is reversed that is supplied by the commercial power supply 101 via the overcurrent protection element 108, the noise filter 109, and the relay 110, and outputs the detecting signal to the control unit 103.

The control unit 103 is a microcomputer including the CPU 122 and the storage unit 123 such as a read only memory (ROM) and a random access memory (RAM). The CPU 122 is connected to the storage unit 123 that stores therein computer programs and data that control the MFP 200, and executes computer programs stored in the storage unit 123. Thus, the CPU 122 performs control operations for the printer engine, and power supply circuits, for example, as well as stores various information related to the control operations in the storage unit 123.

The control operations performed by the control unit 103 are described in brief blow. The control unit 103 supplies a DC power supplied by the DC power supply 105 to the motor 106, a document feeder such as the ADF, the LCT that feeds recording media, and the post processing device that provides post processing, such as stapling, with recording media after printing.

The control unit 103 outputs a power supply signal to the first to third voltage supply circuits 115 to 117 according to a switch-on duty in, for example, time period during which power is supplied from the first to third voltage supply circuits 115 to 117 to the first to third heating units 112 to 114, thereby supplying power to the first to third heating units 112 to 114. In the present embodiment, the control unit 103 outputs a power supply signal in a predetermined cycle shorter than the cycle of the power supplied by the commercial power supply 101. In is applicable that the cycle at which the commercial power supply 101 supplies power is stored in the storage unit 123 in advance, or is calculated according to timings of detecting signals input by the zero crossing detecting circuit 118.

In the present embodiment, the control unit 103 calculates a predetermined cycle (for example, 1 second) at which a power supply signal is supplied to the first to third voltage supply circuits 115 to 117 that is shorter than the cycle at which the commercial power supply 101 supplies power according to timings of detecting signals input by the zero crossing detecting circuit 118. The present invention, however, is not limited thereto. For example, the control unit 103 includes a timer (not shown) that generates an interrupt every 10 milliseconds, and determines that a predetermined cycle has passed when the number of interrupts from the timer reaches 100 (10 milliseconds multiplied by 100 is equal to 1 second). Each time a predetermined cycle has passed, the control unit 103 outputs a power supply signal to the first to third voltage supply circuits 115 to 117 according to a switch-on duty.

An example of a determining operation of a switch-on duty for outputting a power supply signal is described blow in detail. According to a table (hereinafter, "temperature table") in which the differences between the detected temperature of the heating target members (the heating roller 131 and the pressing roller 125) detected by the first to third temperature detecting circuits 119 to 121 and the target temperature are associated with a switch-on duty that is a time period during which power is supplied to the first to third heating units 112 to 114 that can be determined by the differences, the control unit 103 determines a switch-on duty corresponding to the differences between the detected temperatures of the heating target members and the target temperature. Then, the control unit 103 supplies power supply signals to the first to third voltage supply circuits 115 to 117 according to the determined switch-on duty. Here, the power supply signals are signals that the control unit 103 outputs to the first to third voltage supply circuits 115 to 117 according to the switch-on duty determined according to the temperature table as described above, and switch on/off of power supply from the first to third voltage supply circuits 115 to 117. The temperature table is stored in the storage unit 123 in advance. Thus, by determining a switch-on duty that is output to the first to third voltage supply circuits 115 to 117 according to the temperature detected by the first to third temperature detecting circuits 119 to 121, the flicker and the like can be suppressed while temperature ripple of the heating target members can be reduced.

A power supply process by which power is supplied to the first to third heating units 112 to 114 by the CPU 122 that executes computer programs stored in the storage unit 123 in the control system 100 and in which a flicker priority mode is set in the MFP 200 is described in detail below. FIG. 5 is a schematic diagram of a functional configuration of the control unit 103 that performs process for supplying power to the heating units when the flicker priority mode is set. Here, the flicker priority mode is a mode in which voltage fluctuation occurring due to the first to third voltage supply circuits 115 to 117 supplying power to the first to third heating units 112 to 114 is restricted. In the present embodiment, the flicker priority mode can be set by using the operation unit (not shown). As shown in FIG. 5, the control unit 103 includes a supply control unit 103*a*.

The supply control unit 103*a* determines if the detected temperature of the heating target members detected by the first to third temperature detecting circuits 119 to 121 are lower than the target temperature every predetermined cycle measured according to timings of detecting signals input by the zero crossing detecting circuit 118. In the present embodiment, it is determined if it is determined that the predetermined cycle has passed by incrementing a counter (not shown) (hereinafter, "predetermined cycle counter") according to timings of detecting signals input by the zero crossing detecting circuit 118. The present invention, however, is not limited thereto. For example, by employing a timer (not shown) that generates an interrupt every 10 milliseconds, the supply control unit 103*a* determines that the predetermined cycle has passed when the number of the interrupts from the timer reaches 100 (10 milliseconds multiplied by 100 is equal to 1 second). The supply control unit 103*a* outputs power supply signals to the first to third voltage supply circuits 115 to 117 each time the predetermined cycle has passed according to the temperature detected from the first to third temperature detecting circuits 119 to 121 after performing the processes that are described later.

If it is determined that the temperatures of the heating target members are lower than the target temperature, the supply control unit 103*a* supplies power to the heating unit that is grouped as the first-priority heating unit in the grouping of the first to third heating units 112 to 114 for each operation mode in the table stored in the storage unit 123 among the first to third heating units 112 to 114 that heat the heating target member with a temperature detected to be lower than the target temperature, then, selects one of the heating units grouped as the second-priority heating units and supplies power to the selected second-priority heating unit. In the present embodiment, as described above, the supply control unit 103*a* outputs power supply signals to the first to third voltage supply circuits 115 to 117, thereby controlling power supply to the first to third heating units 112 to 114. Thus, repetition of a cycle of switching on and off of all the first to third heating units 112 to 114 can be prevented. Therefore, occurrence of the flicker can be suppressed. In the present embodiment, power can be supplied to the first to third heating units 112 to 114 according to the grouping of the first to third heating units 112 to 114 in each operation mode stored in the storage unit 123. Therefore, power can be appropriately supplied thereto in each operation mode.

In the present embodiment, when the flicker priority mode is set, among the heating units that heat the heating target members with a temperature detected to be lower than the target temperature, power is supplied to the heating unit grouped as the first-priority heating unit, as well as power is selectively supplied to the heating unit grouped as the second-priority heating unit. The present invention, however, is not limited thereto. For example, among the heating units that heat the heating target members with a temperature detected to be lower than the target temperature, power can be always supplied to a heating unit grouped as the first-priority heating unit, as well as power can be always selectively supplied to a heating unit grouped as the second-priority heating unit regardless of the flicker priority mode.

In the present embodiment, the supply control unit 103*a* selects one of the second-priority heating units that heat the heating target members with a temperature detected to be lower than the target temperature, and supplies power to the heating unit. The present invention is, however, not limited thereto, as long as power is supplied selectively to the second-priority heating units. For example, if there are five second-priority heating units, two heating units can be selected among the five heating units and power can be supplied to the two heating units.

An operation of selecting the second-priority heating units is described in detail below. The supply control unit 103*a* selects one of the heating units grouped as the second-priority heating units according to a first supply condition regarding comparative relationship of the difference between the detected temperature and the target temperature, a second supply condition regarding comparative relationship between time period during which power is not supplied thereto, or a third supply condition regarding time period during which power is supplied thereto according to the detected temperature. Then, the supply control unit 103*a* supplies power to the selected heating unit. More specifically, if a heating unit cannot be selected according to the first supply condition having the highest urgency (i.e., the differences between the detected temperature and the target temperature are equal), the supply control unit 103*a* selects one of the second-priority heating units according to the second supply condition having the second highest urgency, and then, supplies power to the selected heating unit. If a heating unit cannot be selected according to the second supply condition (i.e., time periods during which power is not supplied thereto are the same), the supply control unit 103*a* selects one of the heating units according to the third supply condition, and then, supplies power to the selected heating unit. Thus, the flicker can be suppressed, and the heating unit that requires power supply the most can be selected and supplied with power.

More specifically, the supply control unit 103*a* selects the second-priority heating unit that heats the heating target member with the biggest difference between the detected temperature and the target temperature after being heated by the second-priority heating unit, according to the first supply condition. Thus, the heating target member with the biggest difference between the temperature and the target temperature can be selected. Therefore, a temperature of only a heating target member that is heated by a particular heating unit can be prevented from rising and dropping.

If the differences between the detected temperature of the heating target members that are heated by the second-priority heating units and the target temperature are equal, the supply control unit 103*a* selects the second-priority heating unit having the longest period during which power is not supplied thereto, according to the second supply condition. In the present embodiment, the second supply condition is regarding comparative relationship of the periods during which power is not supplied to the first to third heating units 112 to 114 when the first to third heating units 112 to 114 are grouped as the second-priority heating units (hereinafter, "switch off period"). The supply control unit 103*a* measures only switch off periods of the heating units when the heating units are grouped as the second-priority heating units, thereby saving resources. More specifically, the supply control unit 103*a* increments a counter (not shown) (hereinafter, "switch off period counter") of each of the first to third heating units 112 to 114 each time a predetermined cycle (1 second) measured according to timings of detecting signals input by the zero crossing detecting circuit 118 has passed. Thus, the supply control unit 103*a* measures a switch off period during which power is not supplied to the first to third heating units 112 to 114. When power supply to the first to third heating units 112 to 114 are started, the supply control unit 103*a* resets the switch off period counter associated with the heating unit to which power supply is started. It is applicable that the switch off period counter measures only the switch off periods of the second-priority heating unit.

If the switch off periods of the second-priority heating units are the same, the supply control unit 103*a* selects the second-priority heating unit having the biggest switch-on duty according to the detected temperature of the heating target members, according to the third supply condition. In the present embodiment, the supply control unit 103*a* selects the second-priority heating unit having the biggest switch-on duty associated with the detected temperature of the heating target members in the temperature table stored in the storage unit 123. In the present embodiment, a switch-on duty of the second-priority heating unit is determined by using the temperature table. The present invention is, however, not limited thereto. For example, the supply control unit 103*a* can calculate a switch-on duty required to raise a temperature of the heating target member to the target temperature according to the detected temperature of the heating target member, and can select the second-priority heating unit having the calculated biggest switch-on duty. A switch-on duty is calculated according to a proportional-integral-derivative (PID) control or according to a relational expression that can derive a switch-on duty.

Figure 6:
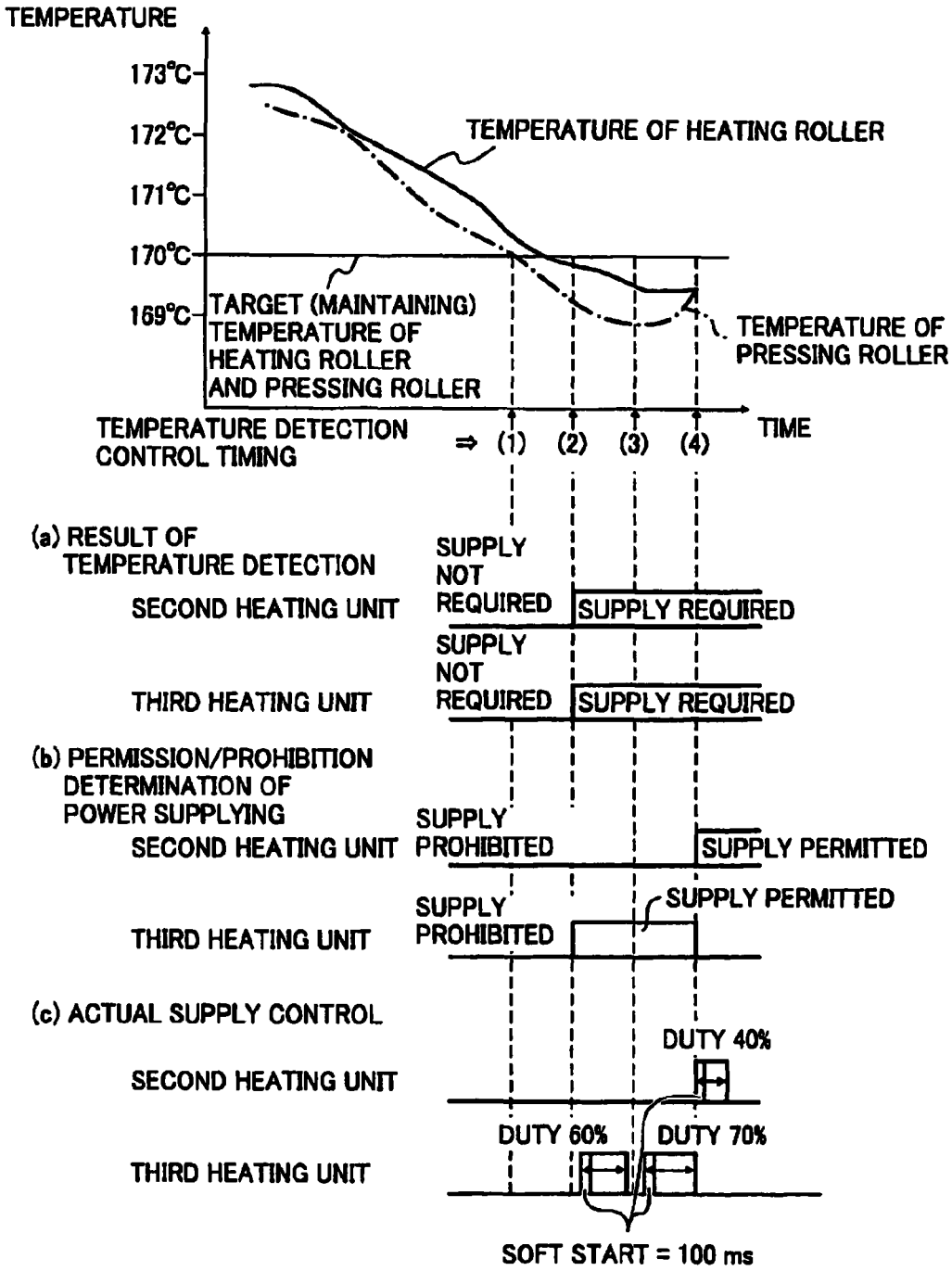
FIG. 6 is a schematic diagram for explaining an example of processes for supplying power to a second-priority heating unit in (4) standby for printing or copying.

FIG. 6 is a schematic diagram for explaining an example of processes for supplying power to the second-priority heating unit in (4) standby for printing or copying. The first heating unit 112 is grouped as the first-priority heating unit in standby for printing or copying. Therefore, power is supplied to the first heating unit 112 in all the conditions as long as the temperature of the heating roller 131 detected by the first temperature detecting circuit 119 is lower than the target temperature.

At a temperature detection control timing (1), the temperatures of the heating roller 131 and the pressing roller 125 that are heated by the second heating unit 113 and the third heating unit 114 that are the second-priority heating units are both higher than the target temperature. Therefore, power is not supplied to the second heating unit 113 or the third heating unit 114.

On the other hand, at temperature detection control timings (2) and (3), the temperatures of the heating roller 131 and the pressing roller 125 heated by the second heating unit 113 and the third heating unit 114 that are the second-priority heating units are both lower than the target temperature. Therefore, power supply to the second heating unit 113 and the third heating unit 114 are both required. The second heating unit 113 and the third heating unit 114 are, however, both grouped as the second-priority heating units. Therefore, the supply control unit 103*a* controls to selectively supply power to the second heating unit 113 or the third heating unit 114. More specifically, at the temperature detection control timings (2) and (3), the difference between the temperature of the pressing roller 125 and the target temperature is larger than the difference between the temperature of the heating roller 131 and the target temperature. Therefore, power is supplied only to the third heating unit 114. At the temperature detection control timing (2), a power supply rate is set to 60% in the first 100 seconds after power supply is started. Thus, heating performed by the third heating unit 114 is soft started. At the temperature detection control timing (3), a power supply rate is set to 70% in the first 100 seconds after power supply is started. Thus, heating performed by the third heating unit 114 is soft started.

In the present embodiment, a power supply rate in the first 100 seconds is set to 60% or 70%, and thus, heating performed by the heating units is soft started. The present invention is not, however, limited thereto, as long as heating performed by the heating units is increased gradually.

In the present embodiment, a soft start period of 100 milliseconds is included in the switch-on duty. The present invention is, however, not limited thereto. For example, power can be supplied to a heating unit in a switch-on duty not including a period during which soft start or soft stop is performed. Here, soft start/soft stop is to control an amount of power supplied to a heating unit so that the amount is increased or decreased gradually, and is controlled by the control unit 103. Thus, voltage fluctuation generated by power supply can be suppressed.

At a temperature detection control timing (4), the temperatures of the heating roller 131 and the pressing roller 125 heated by the second heating unit 113 and the third heating unit 114 that are the second-priority heating units are both lower than the target temperature. Therefore, the second heating unit 113 and the third heating unit 114 both require power supply. The second heating unit 113 and the third heating unit 114 are, however, grouped as the second-priority heating units. Therefore, the supply control unit 103*a* selects the second heating unit 113 or the third heating unit 114, and then, supplies power to the selected heating unit. More specifically, at the temperature detection control timing (4), the difference between a temperature of the pressing roller 125 and the target temperature and the difference between a temperature of the heating roller 131 and the target temperature are equal. The switch off period of the second heating unit 113 is, however, longer than the switch off period of the third heating unit 114. Therefore, power is supplied only to the second heating unit 113. At the temperature detection control timing (4), a power supply rate in the first 100 seconds after power supply is started is set to 40%. Thus, heating performed by the second heating unit 113 is soft started.

If it is assumed that the switch off periods of the second heating unit 113 and the third heating unit 114 are the same at the temperature detection control timing (4), the switch-on duties of the second heating unit 113 and the third heating unit 114 are determined, and then, power is supplied to the heating unit having the bigger switch-on duty. For example, if a switch-on duty of the second heating unit 113 is 40% and a switch-on duty of the third heating unit 114 is 60%, power is supplied to the third heating unit 114.

In the present embodiment, a heating unit to which power is supplied is selected according to the first supply condition (i.e., the detected temperature of a heating target member), the second supply condition (i.e., a switch off period of a heating unit), or the third supply condition (a switch-on duty of a heating unit). The present invention is, however, not limited thereto. For example, a heating unit can be selected according to a priority order set to each heating unit in advance or according to information such as power consumption of each heating unit.

Thus, by supplying power only to one of the heating units grouped as the second-priority heating units, power is supplied to at most two heating units including the first-priority heating unit during the same control cycle at (4) standby. Therefore, power control appropriate for each operation mode can be achieved while the flicker is suppressed.

Figure 7:
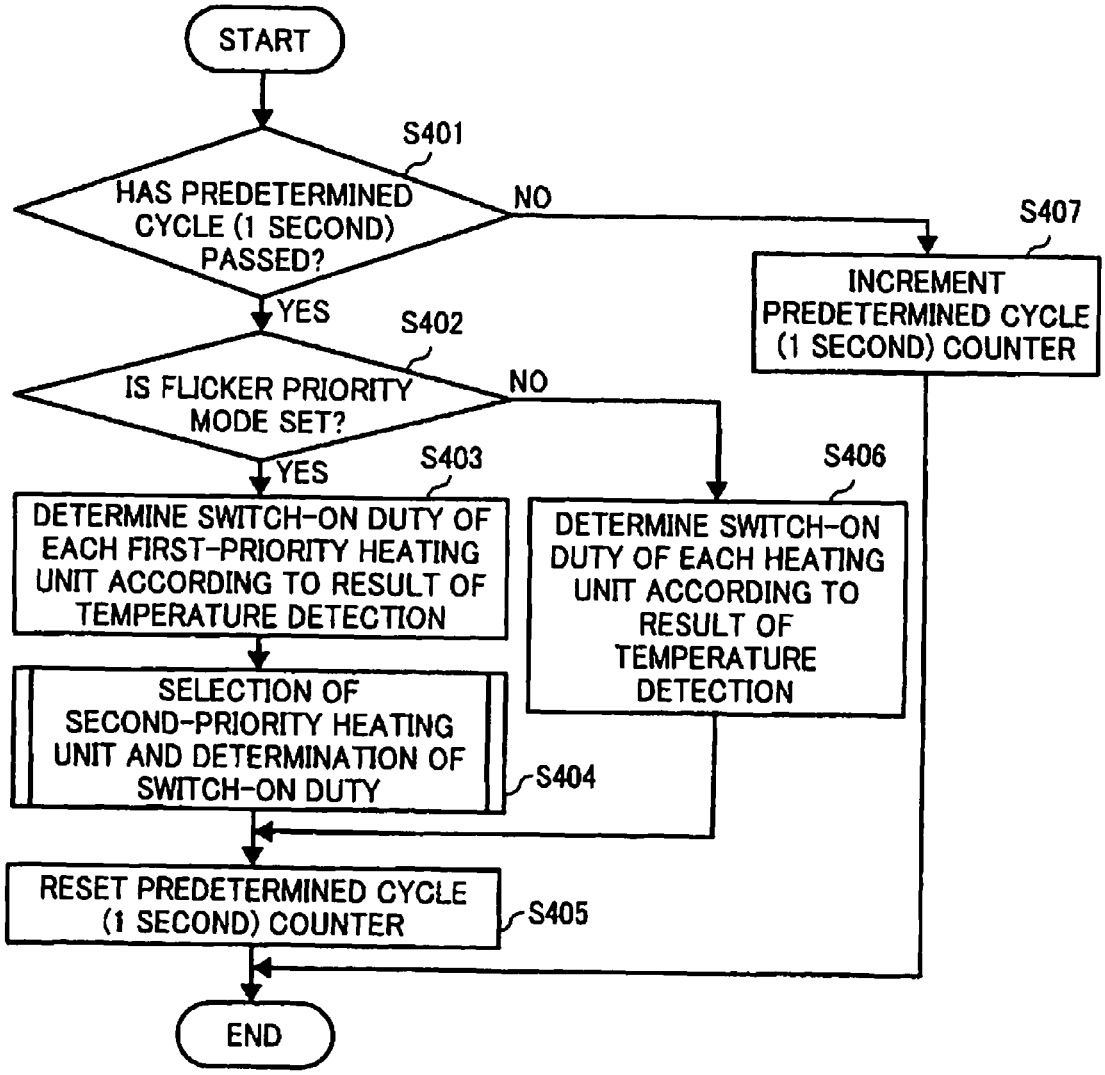
FIG. 7 is a flowchart of procedures performed in a process for supplying power to the second-priority heating unit in (4) standby for printing or copying.

With reference to FIG. 7, procedures performed in the process for supplying power to the second-priority heating unit are described in detail blow. FIG. 7 is a flowchart of procedures performed in the process for supplying power to the second-priority heating unit in (4) standby for printing or copying.

The supply control unit 103*a* determines if the predetermined cycle that is measured by the predetermined cycle counter has passed (Step S401). If it is determined that the predetermined cycle has passed (Yes at Step S401), the supply control unit 103*a* determines if the flicker priority mode is set in the MFP 200 (Step S402). The flicker priority mode can be arbitrarily set by a user or a service technician, for example, by using the operation screen (not shown) of the MFP 200. If it is determined that the flicker priority mode is not set therein (No at Step S402), the supply control unit 103*a* determines the switch-on duties associated with the differences between the detected temperature of the heating target members and the target temperature in the temperature table in all the condition in which temperatures of the heating target members are lower than the target temperature regardless of a priority of each of the first to third heating units 112 to 114. The supply control unit 103*a* outputs power supply signals according to the determined switch-on duties (Step S406). After outputting the power supply signals, the supply control unit 103*a* resets the predetermined cycle counter (Step S405).

On the other hand, if it is determined that the flicker mode is set therein (Yes at Step S402), the supply control unit 103*a* determines the switch-on duty of the first heating unit 112 grouped as the first-priority heating unit among the heating units that heat the heating target members with a temperature detected to be lower than the target temperature according to the detected temperature of the heating target members. The supply control unit 103*a* outputs a power supply signal according to the determined switch-on duty (Step S403). Then, the supply control unit 103*a* selects the second heating unit 113 or the third heating unit 114 grouped as the second-priority heating unit among the heating units that heat the heating target members with a temperature detected to be lower than the target temperature, and then, determines the switch-on duty of the selected heating unit. The supply control unit 103*a* outputs a power supply signal according to the determined switch-on duty (Step S404). After outputting the power supply signal, the supply control unit 103*a* resets the predetermined cycle counter (Step S405).

If it is determined that a time measured by the predetermined cycle counter has not reached the predetermined cycle (No at Step S401), the supply control unit 103*a* increments the time measured by the predetermined cycle counter (Step S407).

Figure 8:
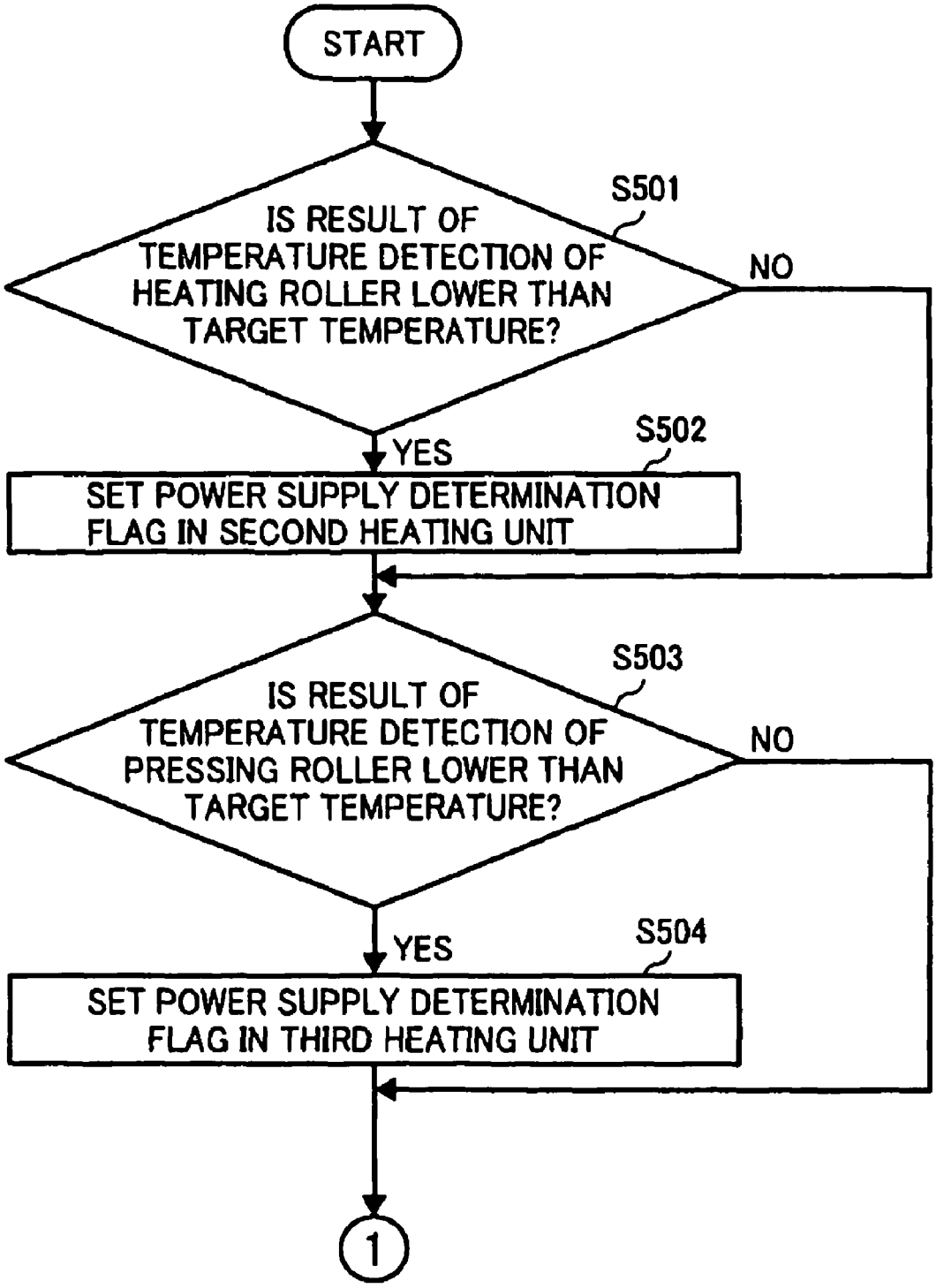
FIG. 8 is a flowchart of procedures for determining a heating unit to which power is supplied among the heating units grouped as second-priority heating units.
Figure 9:
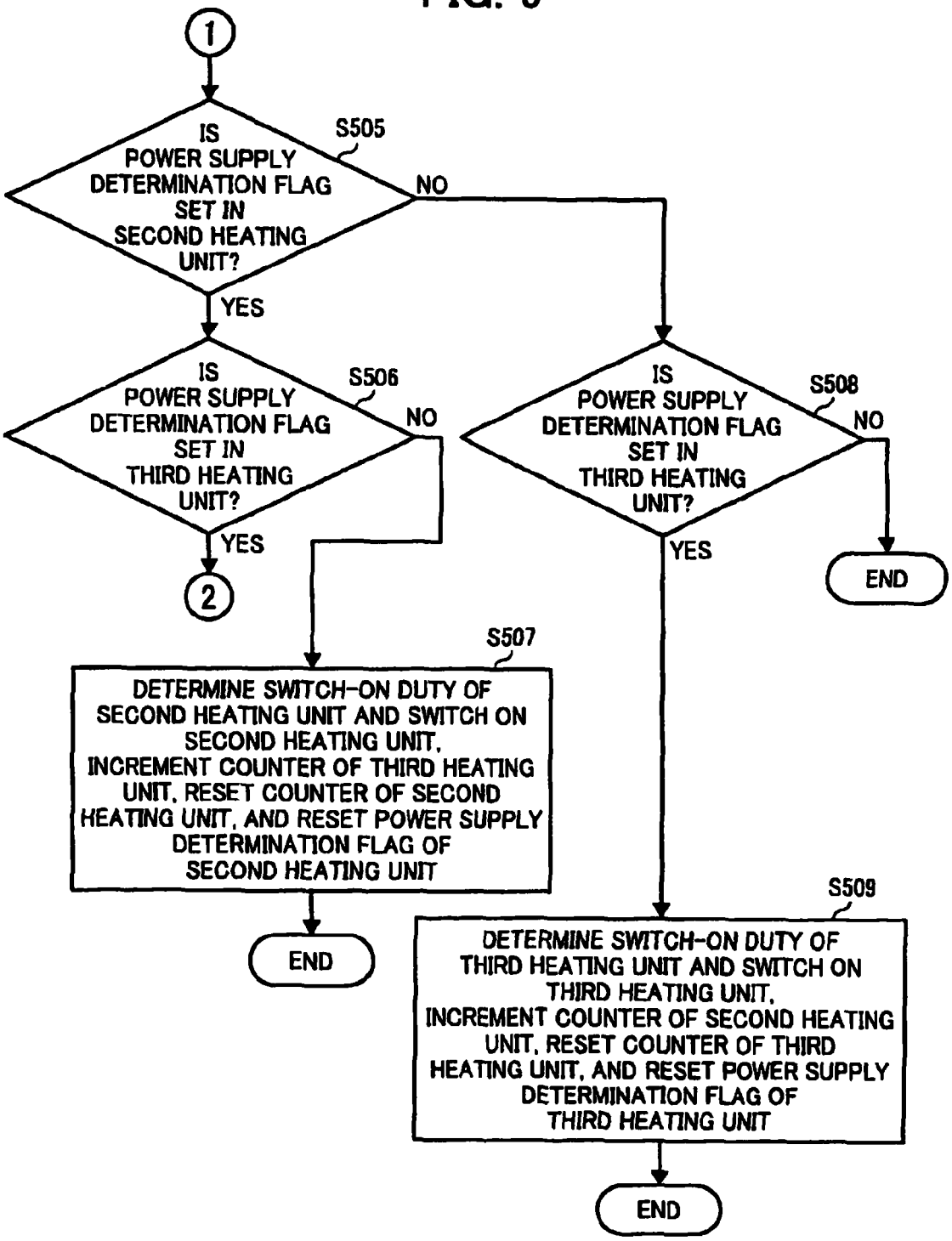
FIG. 9 is a flowchart of procedures for determining a heating unit to which power is supplied among the heating units grouped as second-priority heating units.
Figure 10A:
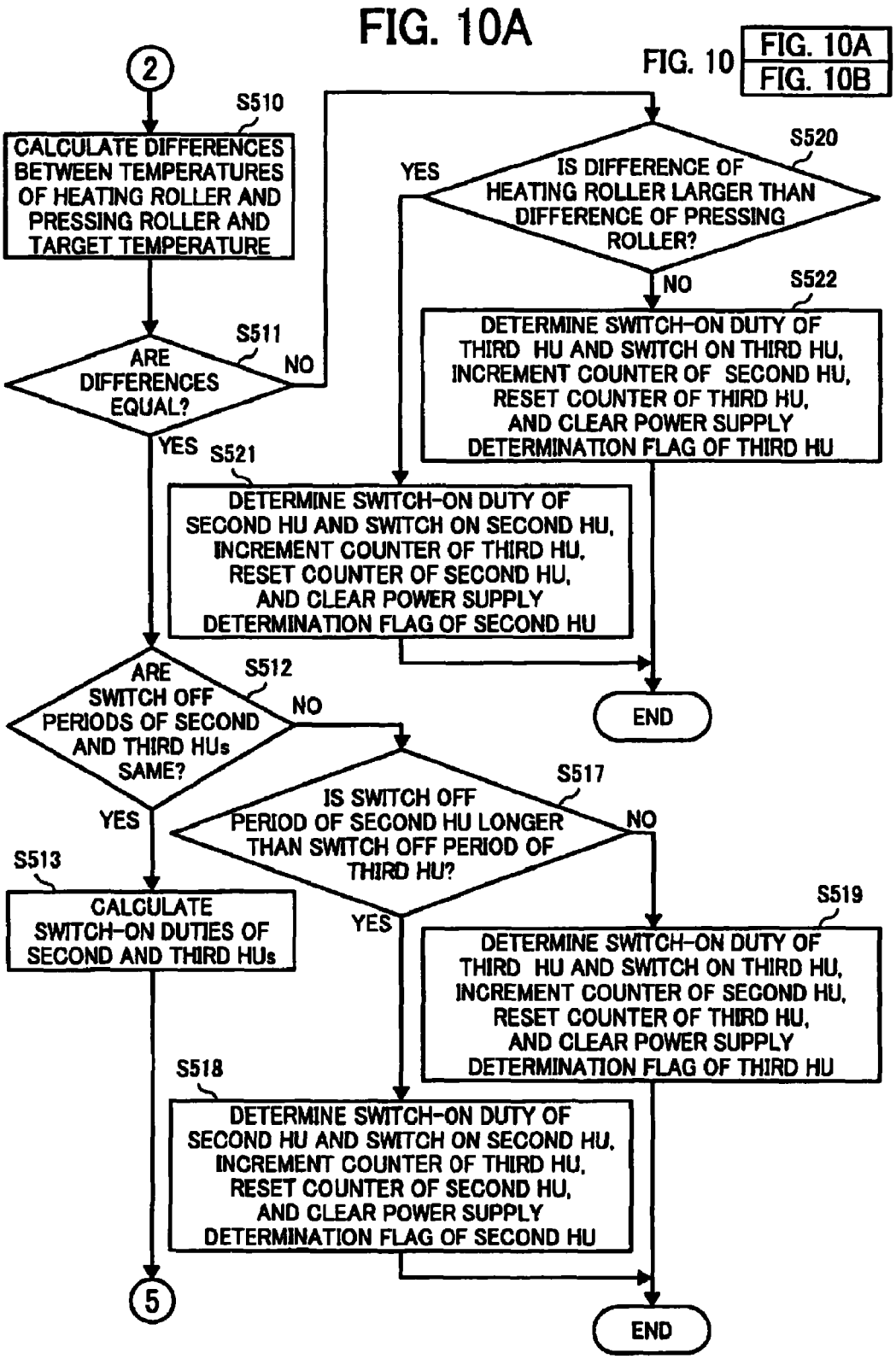
FIG. 10 is a flowchart of procedures for determining a heating unit to which power is supplied among the heating units grouped as second-priority heating units.
Figure 10B:
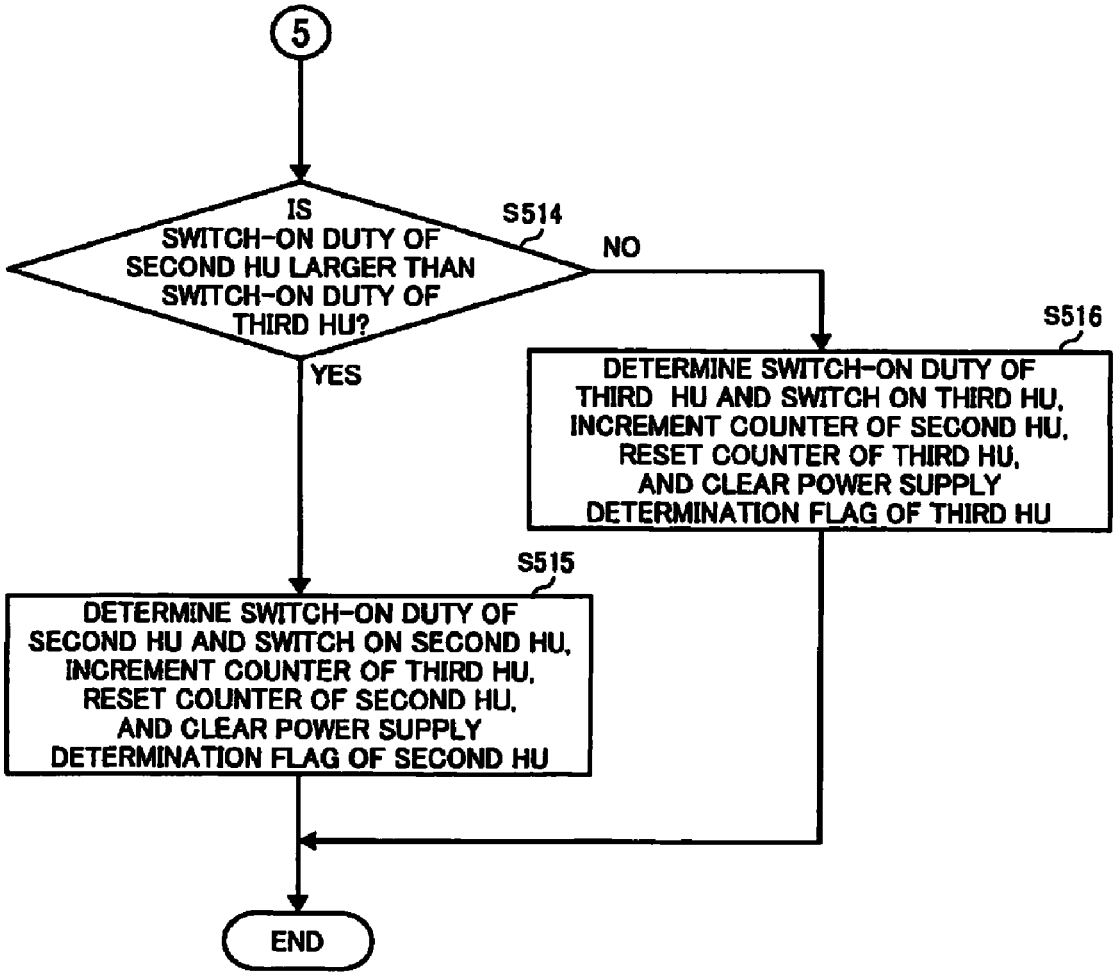

With reference to FIGS. 8 to 10, the process performed at Step S404 shown in FIG. 7 is described in detail below. FIGS. 8 to 10 are flowcharts of procedures performed in the process for selecting a heating unit to which power is supplied among the heating units grouped as the second-priority heating units.

The supply control unit 103*a* obtains the detected temperature of the heating roller 131 from the second temperature detecting circuit 120, and determines if a temperature of the heating roller 131 is lower than the target temperature (Step S501). If it is determined that the temperature of the heating roller 131 is lower than the target temperature (Yes at Step S501), the supply control unit 103*a* sets a power supply determination flag in the second heating unit 113 (Step S502). If it is determined that the temperature of the heating roller 131 is not lower than the target temperature (No at Step S501), the supply control unit 103*a* does not set the power supply determination flag.

Then, the supply control unit 103*a* obtains the detected temperature of the pressing roller 125 from the third temperature detecting circuit 121, and determines if the temperature of the pressing roller 125 is lower than the target temperature (Step S503). If it is determined that the temperature of the pressing roller 125 is lower than the target temperature (Yes at Step S503), the supply control unit 103*a* sets the power supply determination flag in the third heating unit 114 (Step S504). On the other hand, if it is determined that the temperature of the pressing roller 125 is not lower than the target temperature (No at Step S503), the supply control unit 103*a* does not set the power supply determination flag.

Then, the supply control unit 103*a* determines if the power supply determination flag is set in the second heating unit 113 (Step S505). If it is determined that the power supply determination flag is not set in the second heating unit 113 (No at Step S505), the supply control unit 103*a* determines if the power supply determination flag is set in the third heating unit 114 (Step S508).

If it is determined that the power supply determination flag is set in the third heating unit 114 (Yes at Step S508), the supply control unit 103*a* determines (or calculates) the switch-on duty that is associated with the difference between the temperature of the pressing roller 125 detected by the third temperature detecting circuit 121 and the target temperature in the temperature table. The supply control unit 103*a* outputs a power supply signal to the third voltage supply circuit 117 according to the determined switch-on duty (Step S509). The supply control unit 103*a* increments the switch off period counter of the second heating unit 113, resets the switch off period counter of the third heating unit 114, and clears the power supply determination flag set in the third heating unit 114 (Step S509). If it is determined that the power supply determination flag is not set in the third heating unit 114 (No at Step S508), the supply control unit 103*a* does not supply power to the second heating unit 113 or the third heating unit 114.

On the other hand, if it is determined that the power supply determination flag is set in the second heating unit 113 (Yes at Step S505), the supply control unit 103*a* determines if the power supply determination flag is set in the third heating unit 114 (Step S506). If it is determined that the power supply determination flag is not set in the third heating unit 114 (No at Step S506), the supply control unit 103*a* determines (or calculates) the switch-on duty associated with the difference between the temperature of the heating roller 131 detected by the second temperature detecting circuit 120 and the target temperature in the temperature table. The supply control unit 103*a* outputs a power supply signal to the second voltage supply circuit 116 according to the determined switch-on duty (Step S507). The supply control unit 103*a* increments the switch off period counter of the third heating unit 114, resets the switch off period counter of the second heating unit 113, and clears the power supply determination flag set in the second heating unit 113 (Step S507).

If it is determined that the power supply determination flag is set in the second heating unit 113 and the third heating unit 114 (Yes at Step S506), the supply control unit 103*a* calculates the difference between the detected temperature of the heating roller 131 and the target temperature and the difference between the detected temperatures of the pressing roller 125 and the target temperature (Step S510). It is applicable that the differences between the detected temperatures of the heating target members and the target temperature is multiplied with a factor. The supply control unit 103*a* determines if the difference between the detected temperatures of the heating roller 131 and the target temperature and the difference between the detected temperatures of the pressing roller 125 and the target temperature are equal (Step S511).

A process to be performed when it is determined that the difference between the detected temperatures of the heating roller 131 and the target temperature and the difference between the detected temperatures of the pressing roller 125 and the target temperature are not equal (No at Step S511) is described in detail below. First, the supply control unit 103*a* determines if the difference between the detected temperatures of the heating roller 131 and the target temperature is larger than the difference between the detected temperatures of the pressing roller 125 and the target temperature (Step S520).

If it is determined that the difference between the detected temperatures of the heating roller 131 and the target temperature is larger than the difference between the detected temperatures of the pressing roller 125 and the target temperature (Yes at Step S520), the supply control unit 103*a* performs the same process performed at Step S507 described above (Step S521).

On the other hand, if it is determined that the difference between the detected temperatures of the heating roller 131 and the target temperature is smaller than or equal to the difference between the detected temperatures of the pressing roller 125 and the target temperature (No at Step S520), the supply control unit 103*a* performs the same process performed at Step S509 described above (Step S522).

A process to be performed when it is determined that the difference between the detected temperatures of the heating roller 131 and the target temperature and the difference between the detected temperatures of the pressing roller 125 and the target temperature are equal (Yes at Step S511) is described in greater below. First, the supply control unit 103*a* determines if the switch off period of the second heating unit 113 and the switch off period of the third heating unit 114 are the same (Step S512).

If it is determined that the switch off period of the second heating unit 113 and the switch off period of the third heating unit 114 are not the same (No at Step S512), the supply control unit 103*a* determines if the switch off period of the second heating unit 113 is longer than the switch off period of the third heating unit 114 (Step S517). If it is determined that the switch off period of the second heating unit 113 is longer than the switch off period of the third heating unit 114 (Yes at Step S517), the supply control unit 103*a* performs the same process performed at Step S507 described above (Step S518).

On the other hand, if it is determined that the switch off period of the second heating unit 113 is shorter than or equal to the switch off period of the third heating unit 114 (No at Step S517), the supply control unit 103*a* performs the same process performed at Step S509 described above (Step S519).

If it is determined that the switch off period of the second heating unit 113 and the switch off period of the third heating unit 114 are the same (Yes at Step S512), the supply control unit 103*a* determines (or calculates) the switch-on duties of the second heating unit 113 and the third heating unit 114 associated respectively with the difference between the detected temperatures of the heating roller 131 and the target temperature and the difference between the detected temperatures of the pressing roller 125 and the target temperature in the temperature table (Step S513). Then, the supply control unit 103*a* determines if the switch-on duty of the second heating unit 113 is larger than the switch-on duty of the third heating unit 114 (Step S514).

If it is determined that the switch-on duty of the second heating unit 113 is larger than the switch-on duty of the third heating unit 114 (Yes at Step S514), the supply control unit 103*a* performs the same process performed at Step S507 described above (Step S515).

On the other hand, if it is determined that the switch-on duty of the second heating unit 113 is smaller than or equal to the switch-on duty of the third heating unit 114 (No at Step S514), the supply control unit 103*a* performs the same process performed at Step S509 described above (Step S516).

Thus, by supplying power only to one of the heating units grouped as the second-priority heating units according to a priority of each heating unit in each operation mode, power is supplied to at most two heating units including the first-priority heating unit during the same control period in the standby. Therefore, power control appropriate for each operation mode can be achieved while the flicker is suppressed.

Figure 11:
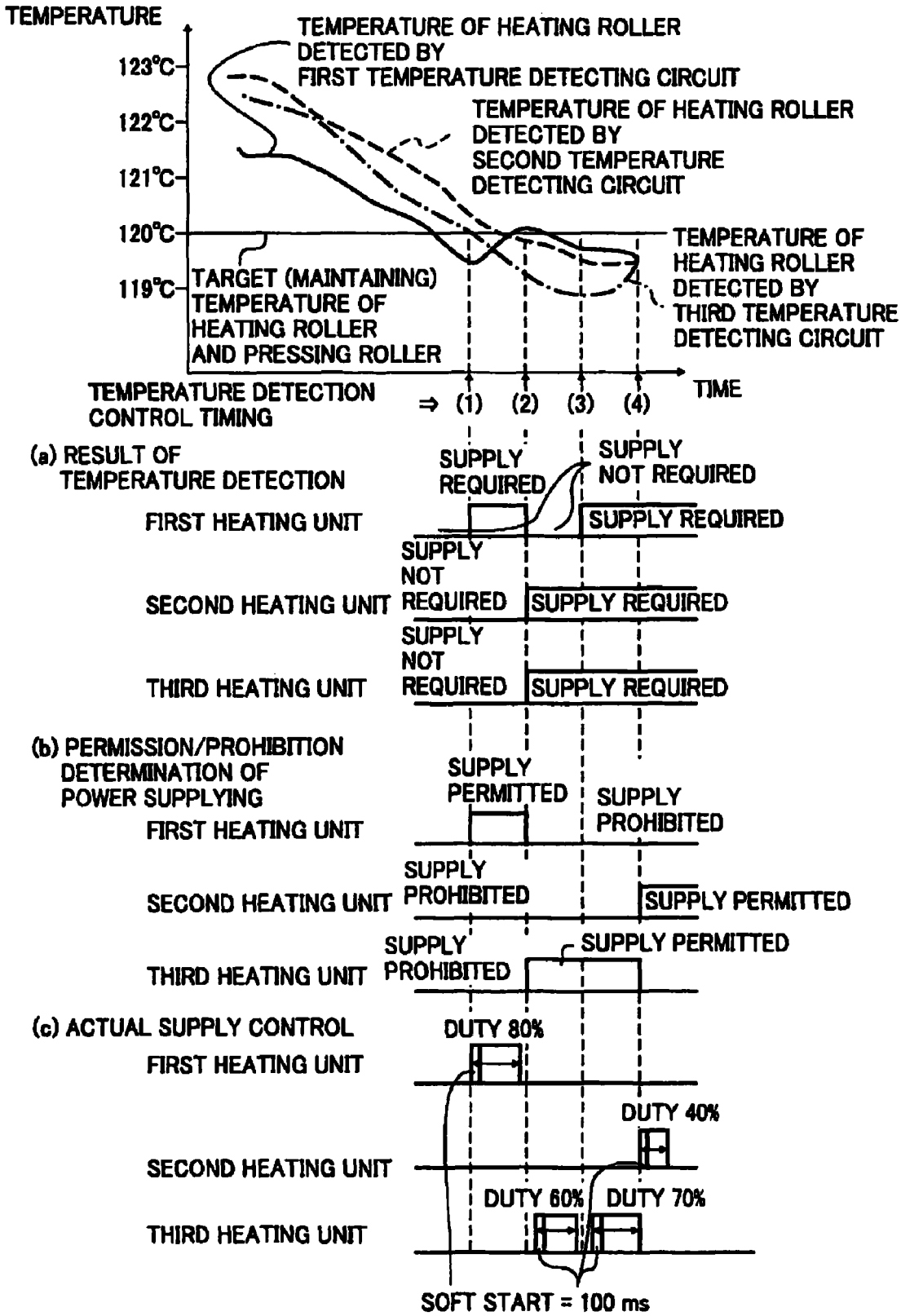
FIG. 11 is a schematic diagram for explaining an example of process for supplying power to a second-priority heating unit in (5) power saving mode.

FIG. 11 is a schematic diagram for explaining an example of process for supplying power to the second-priority heating unit in (5) power saving mode.

At the temperature detection control timing (1), only the temperature of the heating roller 131 detected by the first temperature detecting circuit 119 is lower than the target temperature. Therefore, only the first heating unit 112 requires power supply. Thus, power is supplied only to the first heating unit 112. At the temperature detection control timing (1), the power supply rate is set to 80% in the first 100 seconds after power supply is started. Thus, heating performed by the first heating unit 112 is soft started.

At the temperature detection control timing (2), the temperature of the heating roller 131 detected by the second temperature detecting circuit 120 and the temperature of the pressing roller 125 detected by the third temperature detecting circuit 121 are lower than the target temperature. Therefore, the second heating unit 113 and the third heating unit 114 require power supply. The second heating unit 113 and the third heating unit 114 are, however, grouped as the second-priority heating units. Therefore, the supply control unit 103*a* selects the second heating unit 113 or the third heating unit 114, and then, supplies power to the selected heating unit. More specifically, at the temperature detection control timing (2), the difference between the temperature of the pressing roller 125 detected by the third temperature detecting circuit 121 and the target temperature is larger than the difference between the temperature of the heating roller 131 detected by the second temperature detecting circuit 120 and the target temperature. Therefore, power is supplied only to the third heating unit 114. At the temperature detection control timing (2), a power supply rate is set to 60% in the first 100 seconds after power supply is started. Thus, heating performed by the third heating unit 114 is soft started.

At the temperature detection control timing (3), the temperature of the heating roller 131 detected by the first temperature detecting circuit 119, the temperature of the heating roller 131 detected by the second temperature detecting circuit 120, and the temperature of the pressing roller 125 detected by the third temperature detecting circuit 121 are all lower than the target temperature. Therefore, all the first to third heating units 112 to 114 requires power supply. All of the first to third heating units 112 to 114 are, however, grouped as the second-priority heating units. Therefore, the supply control unit 103*a* selects one of the first to third heating units 112 to 114, and then, supplies power to the selected heating unit. More specifically, at the temperature detection control timing (3), the difference between the temperature of the pressing roller 125 detected by the third temperature detecting circuit 121 and the target temperature is larger than the difference between the temperature detected by the first temperature detecting circuit 119 and the target temperature and than the difference between the temperature detected by the second temperature detecting circuit 120 and the target temperature. Therefore, power is supplied only to the third heating unit 114. At the temperature detection control timing (3), a power supply rate is set to 70% in the first 100 seconds after power supply is started. Thus, heating performed by the third heating unit 114 is soft started.

Similar to the temperature detection control timing (3), at the temperature detection control timing (4), the temperature of the heating roller 131 detected by the first temperature detecting circuit 119, the temperature of the heating roller 131 detected by the second temperature detecting circuit 120, and the temperature of the pressing roller 125 detected by the third temperature detecting circuit 121 are all lower than the target temperature. Therefore, all the first to third heating units 112 to 114 require power supply. All the first to third heating units 112 to 114 are, however, grouped as the second-priority heating units. Therefore, the supply control unit 103*a* selects one of the first to third heating units 112 to 114, and then, supplies power to the selected heating unit. More specifically, at the temperature detection control timing (4), the difference between the temperature of the heating roller 131 detected by the first temperature detecting circuit 119 and the target temperature, the difference between the temperature of the heating roller 131 detected by the second temperature detecting circuit 120 and the target temperature, and the difference between the temperature of the pressing roller 125 detected by the third temperature detecting circuit 121 and the target temperature are all the same. At the temperature detection control timing (4), however, the switch off period of the second heating unit 113 is longer than the switch off periods of the other heating units. Therefore the supply control unit 103*a* selects the second heating unit 113, and thus, supplies power thereto. At the temperature detection control timing (4), a power supply rate is set to 40% in the first 100 seconds after power supply is started. Thus, heating performed by the second heating unit 113 is soft started.

Thus, power is supplied to one heating unit among the heating units grouped as the second-priority heating units according to the priority of a heating unit in an operation mode during the same control cycle. Therefore, the flicker can be suppressed.

Figure 12:
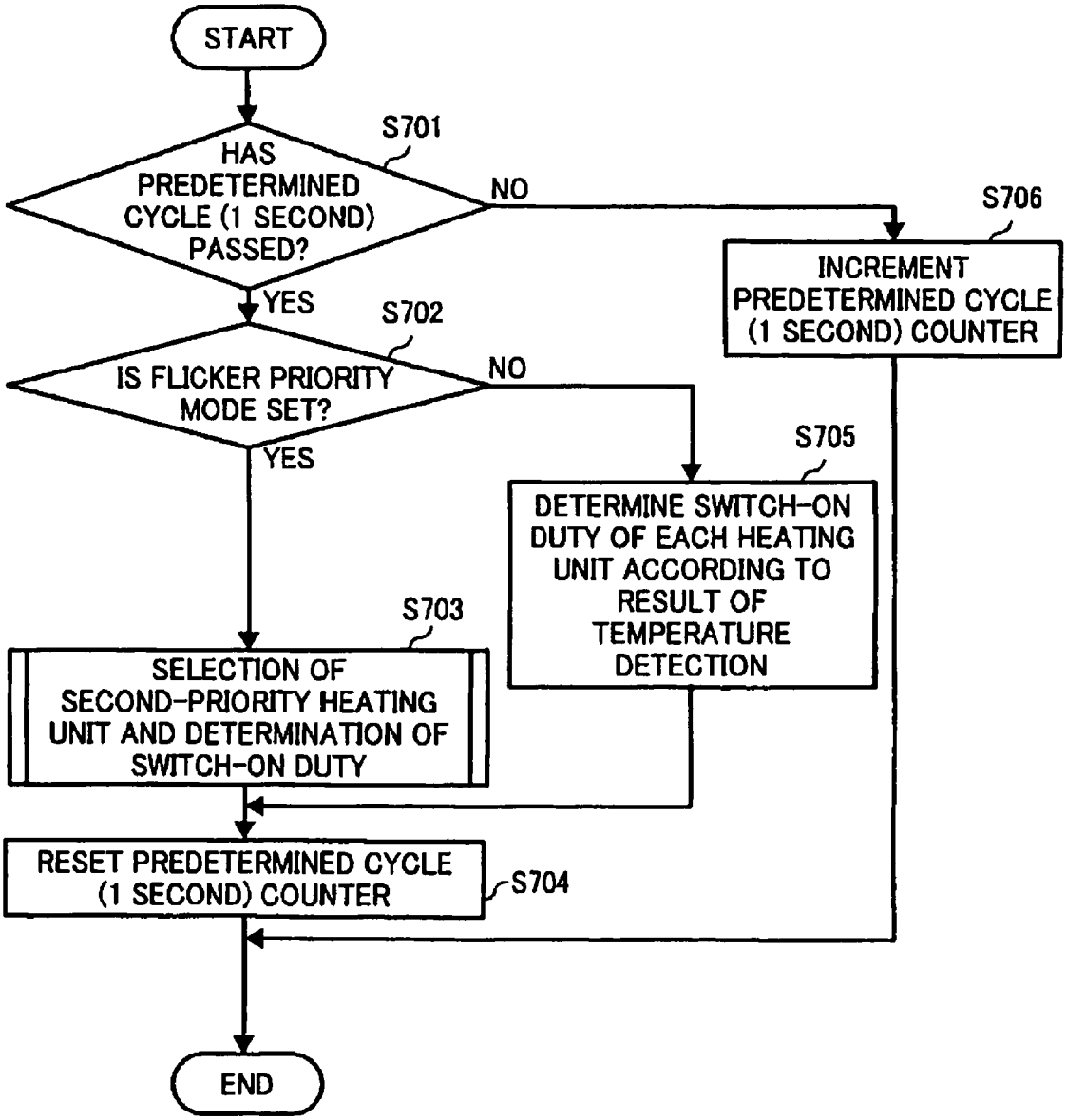
FIG. 12 is a flowchart of procedures performed in a process for supplying power to a second-priority heating unit in (5) power saving mode.

FIG. 12 is a flowchart of procedures performed in a process for supplying power to the second-priority heating unit in (5) power saving mode. As shown in FIG. 12, procedures (Steps S701 to S706) for supplying power to the second-priority heating unit in (5) power saving mode are similar to the procedures shown in FIG. 7. Therefore, the descriptions thereabout are omitted here.

Figure 13:
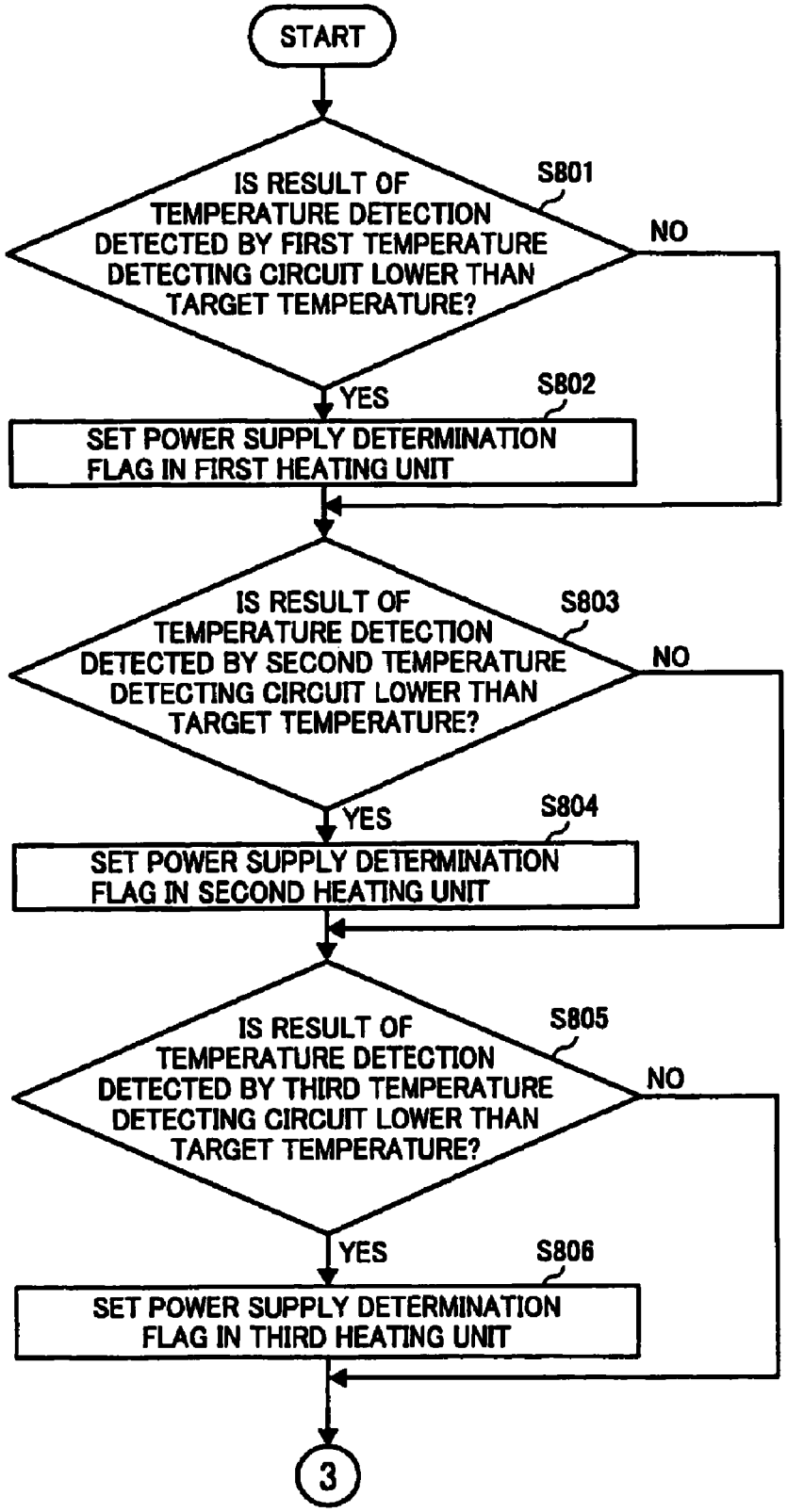
FIG. 13 is a flowchart of procedures for selecting a heating unit to which power is supplied among the heating units grouped as second-priority heating units.
Figure 14:
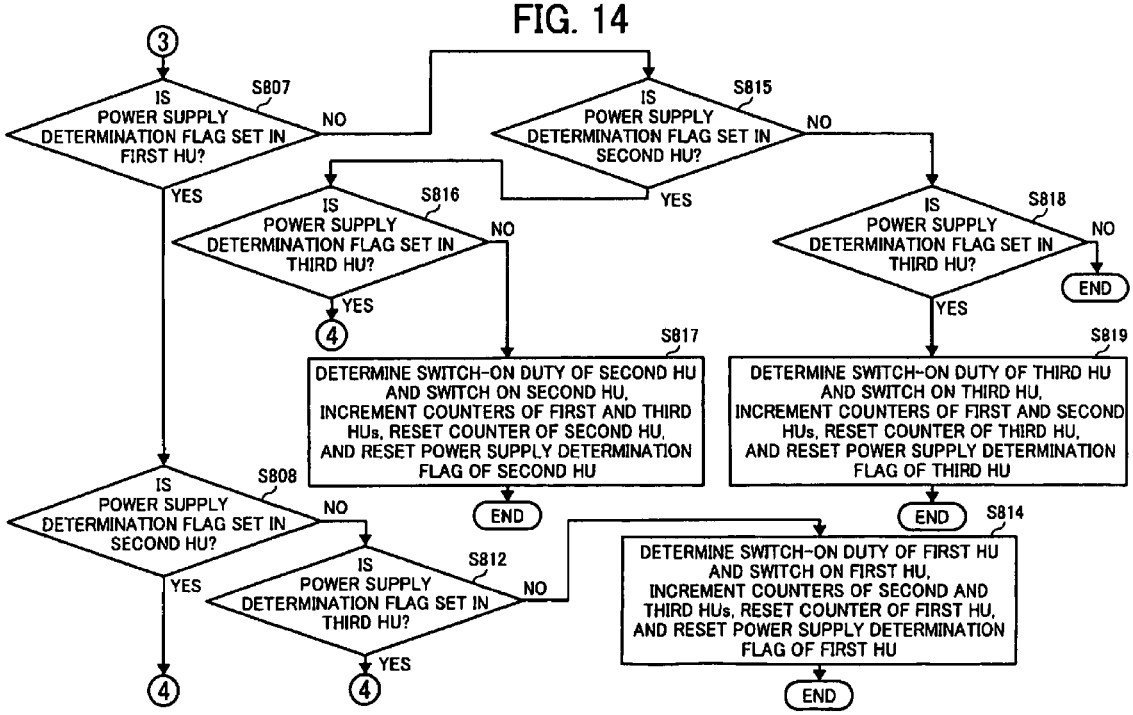
FIG. 14 is a flowchart of procedures for selecting a heating unit to which power is supplied among the heating units grouped as second-priority heating units.
Figure 15:
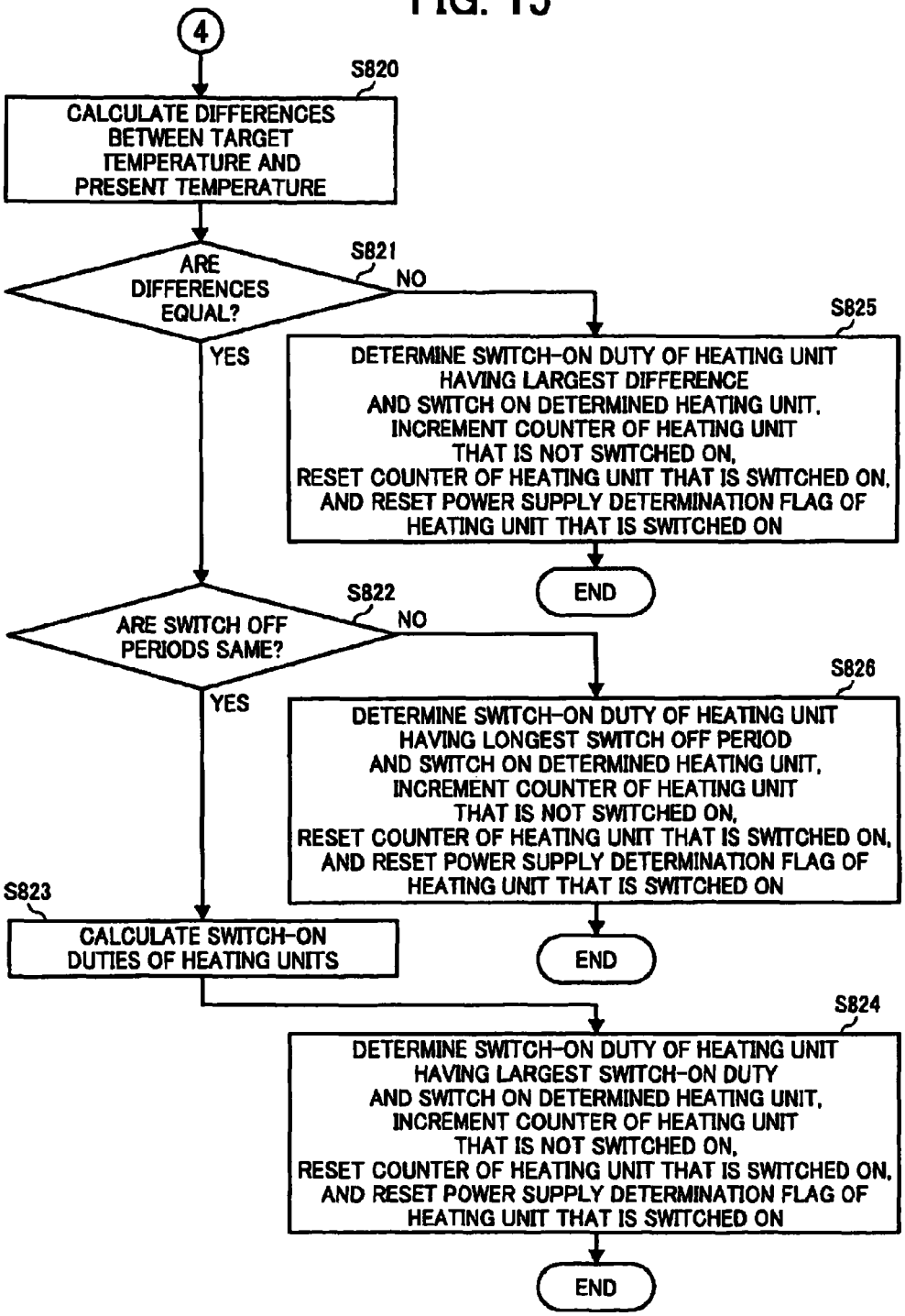
FIG. 15 is a flowchart of procedures for selecting a heating unit to which power is supplied among the heating units grouped as second-priority heating units.

FIGS. 13 to 15 are flowcharts of procedures for selecting a heating unit to which power is supplied among the heating units grouped as the second-priority heating units.

The supply control unit 103*a* obtains the detected temperature of the heating roller 131 from the first temperature detecting circuit 119, and then, determines if the temperature of the heating roller 131 detected by the first temperature detecting circuit 119 is lower than the target temperature (Step S801). If it is determined that the temperature of the heating roller 131 is lower that the target temperature (Yes at Step S801), the supply control unit 103*a* sets the power supply determination flag in the first heating unit 112 (Step S802). On the other hand, if it is determined that the temperature of the heating roller 131 is not lower than the target temperature (No at Step S801), the supply control unit 103*a* does not set the power supply determination flag. A process performed at Step S803 to Step S806 is similar to the process shown in FIG. 8. Therefore, the description thereabout is omitted here.

The supply control unit 103*a* determines if the power supply determination flag is set in the first heating unit 112 (Step S807). If it is determined that the power supply determination flag is not set in the first heating unit 112 (No at Step S807), the supply control unit 103*a* determines if the power supply determination flag is set in the second heating unit 113 (Step S815). If it is determined that the power supply determination flag is not set in the second heating unit 113 (No at Step S815), the supply control unit 103*a* determines if the power supply determination flag is set in the third heating unit 114 (Step S818).

If it is determined that the power supply determination flag is not set in the third heating unit 114 (No at Step S818), the supply control unit 103*a* does not supply power to the first to third heating units 112 to 114. On the other hand, if it is determined that the power supply determination flag is set in the third heating unit 114 (Yes at Step S818), the supply control unit 103*a* determines (or calculates) the switch-on duty that is associated with the difference between the temperature of the pressing roller 125 detected by the third temperature detecting circuit 121 and the target temperature in the temperature table, and then, outputs the power supply signal to the third voltage supply circuit 117 according to the determined switch-on duty (Step S819). Then, the supply control unit 103*a* increments the switch off period counters of the first heating unit 112 and the second heating unit 113, resets the switch off period counter of the third heating unit 114, and clears the power supply determination flag set in the third heating unit 114 (Step S819).

On the other hand, if it is determined that the power supply determination flag is set in the second heating unit 113 (Yes at Step S815), the supply control unit 103*a* determines if the power supply determination flag is set in the third heating unit 114 (Step S816). If it is determined that the power supply determination flag is not set in the third heating unit 114 (No at Step S816), the supply control unit 103*a* determines (or calculates) the switch-on duty that is associated with the difference between the temperature of the heating roller 131 detected by the second temperature detecting circuit 120 and the target temperature in the temperature table, and then, outputs the power supply signal to the second voltage supply circuit 116 according to the determined switch-on duty (Step S817). The supply control unit 103*a* increments the switch off period counters of the first heating unit 112 and the third heating unit 114, resets the switch off period counter of the second heating unit 113, and clears the power supply determination flag set in the second heating unit 113 (Step S817). If it is determined that the power supply determination flag is set in the third heating unit 114 (Yes at Step S816), the system control proceeds to the process shown in FIG. 15.

If it is determined that the power supply determination flag is set in the first heating unit 112 (Yes at Step S807), the supply control unit 103*a* determines if the power supply determination flag is set in the second heating unit 113 (Step S808). If it is determined that the power supply determination flag is set in the second heating unit 113 (Yes at Step S808), the system control proceeds to the process shown in FIG. 15.

On the other hand, if it is determined that the power supply determination flag is not set in the second heating unit 113 (No at Step S808), the supply control unit 103*a* determines if the power supply determination flag is set in the third heating unit 114 (Step S812). If it is determined that the power supply determination flag is not set in the third heating unit 114 (No at Step S812), the supply control unit 103*a* determines (or calculates) the switch-on duty that is associated with the difference between the temperature of the heating roller 131 detected by the first temperature detecting circuit 119 and the target temperature in the temperature table, and then, outputs the power supply signal to the first voltage supply circuit 115 (Step S814). The supply control unit 103*a* increments the switch off period counters of the second heating unit 113 and the third heating unit 114, resets the switch off period counter of the first heating unit 112, and clears the power supply determination flag set in the first heating unit 112 (Step S814). If it is determined that the power supply determination flag is set in the third heating unit 114 (Yes at Step S812), the system control proceeds to the process shown in FIG. 15.

A process to be performed when it is determined that the power supply determination flag is set in two or more heating units at Steps S808, S812, and S816 is described in detail below.

The supply control unit 103*a* calculates the difference between the temperature of each of the heating target members (the heating roller 131 and the pressing roller 125) heated by each of the heating units in which the power supply determination flag is set and the target temperature (Step S820). The supply control unit 103*a* determines if all the calculated differences are equal (Step S821).

If it is determined that the calculated differences thus thereby are not equal (No at Step S821), the supply control unit 103*a* determines the switch-on duty of the heating unit that heats the heating target member having the largest difference, and then, outputs the power supply signal to the voltage supply circuit according to the calculated switch-on duty (Step S825). Then, the supply control unit 103*a* increments the switch off period counter of a heating unit that is not switched on, resets the switch off period counter of a heating unit that is switched on, and clears the power supply determination flag set in a heating unit that is switched on (Step S825).

If it is determined that all the calculated differences are equal (Yes at Step S821), the supply control unit 103*a* determines if the switch off periods measured by the switch off period counters of the heating units are the same (Step S822). If it is determined that the switch off periods of the heating units are not the same (No at Step S822), the supply control unit 103*a* determines the switch-on duty of the heating unit having the longest switch off period, and then, outputs the power supply signal to the voltage supply circuit according to the calculated switch-on duty (Step S826). Then, the supply control unit 103*a* increments the switch off period counter of a heating unit that is not switched on, resets the switch off period counter of a heating unit that is switched on, and clears the power supply determination flag set in a heating unit that is switched on (Step S826).

If it is determined that all the switch off periods of the heating units are the same (Yes at Step S822), the supply control unit 103*a* determines (or calculates) the switch-on duties of the heating units (Step S823). The supply control unit 103*a* selects the heating unit having the largest switch-on duty, and outputs the power supply signal to the voltage supply circuit according to the calculated switch-on duty (Step S824). Then, the supply control unit 103*a* increments the switch off period counter of a heating unit that is not switched on, resets the switch off period counter of a heating unit that is switched on, and clears the power supply determination flag set in a heating unit that is switched on (Step S824).

Thus, according to the present embodiment, power is supplied only to one heating unit among the two heating units grouped as the second-priority heating units. Thus, fluctuation of power supply voltage due to power supply to a heating unit can be suppressed, thereby suppressing the flicker.

In the embodiment described above, the supply control unit 103*a* selects one of the heating units grouped as the second-priority heating units, and then, supplies power to the selected heating unit. In a modification of the above embodiment, however, a plurality of heating units is selected among the heating units grouped as the second-priority heating units, and then, power is supplied thereto, depending on the status of power supply to the first-priority heating unit. For example, if power is not supplied to the first-priority heating unit, two heating units can be selected among the heating units grouped as the second-priority heating units, and then, power can be supplied thereto. Then, depending on a condition of the power capacity and the current consumption of the heating unit, the flicker can be suppressed. Description of the configuration similar to the first embodiment is omitted below, and only the configuration different from the first embodiment is described in detail below.

If power is not supplied to the first-priority heating unit, the supply control unit 103*a* selects two heating units among the heating units grouped as the second-priority heating units, and then, supplies power thereto. The present modification is similar to the first embodiment in that the number of the heating units to which power is supplied simultaneously is at most two. Therefore, the flicker can be suppressed, similarly to the first embodiment.

Thus, according to the present modification, if power is not supplied to a heating unit grouped as the first-priority heating unit, power is supplied to two heating units grouped as the second-priority heating units.

Figure 16:
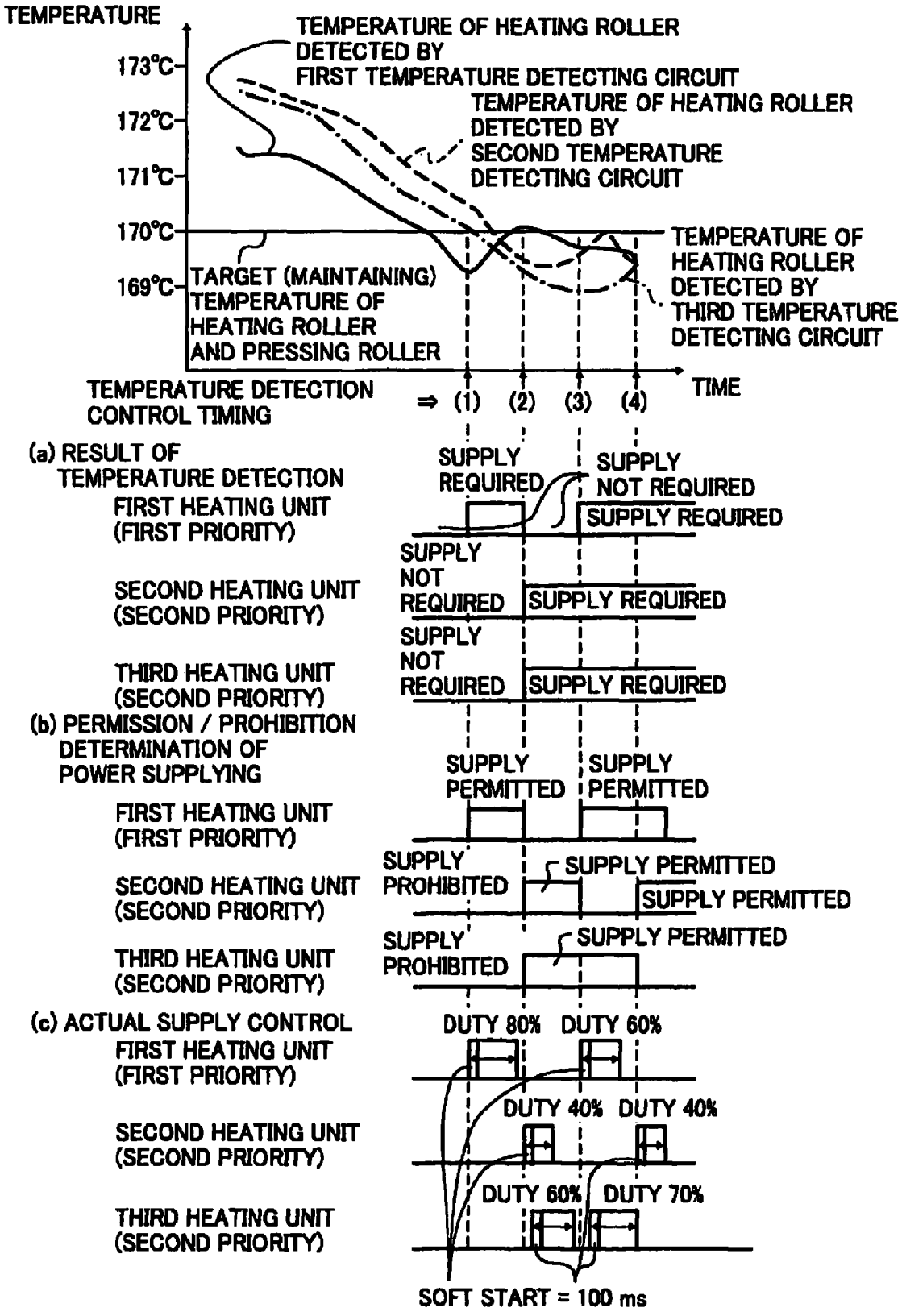
FIG. 16 is a schematic diagram for explaining an example of a process for supplying power to a heating unit in (4) standby for printing or copying.

FIG. 16 is a schematic diagram for explaining an example of a process for supplying power to a heating unit in (4) standby for printing or copying.

At the temperature detection control timing (2), only the temperature of the heating roller 131 detected by the first temperature detecting circuit 119 is lower than the target temperature. Thus, only the first heating unit 112 requires power supply. Therefore, power is supplied only to the first heating unit 112. At the temperature detection control timing (1), a power supply rate is set to 80% in the first 100 seconds after power supply is started. Thus, heating performed by the first heating unit 112 is soft started.

At the temperature detection control timing (2), the temperature of the heating roller 131 detected by the second temperature detecting circuit 120 and the temperature of the pressing roller 125 detected by the third temperature detecting circuit 121 are lower than the target temperature. Therefore, both the second heating unit 113 and the third heating unit 114 require power supply. At the temperature detection control timing (2), the temperature of the heating roller 131 heated by the first heating unit 112 is higher than the target temperature. Therefore, the supply control unit 103*a* selects the second heating unit 113 and the third heating unit 114 that are grouped as the second-priority heating unit, and then, supplies power thereto. At the temperature detection control timing (2), a power supply rate is set to 40% in the first 100 seconds after power supply is started. Thus, heating performed by the second heating unit 113 is soft started. A power supply rate is set to 60% in the first 100 seconds after power supply is started. Thus, heating performed by the third heating unit 114 is soft started.

In the present embodiment, to suppress the flicker caused by supplying power to two heating units in the same control cycle, the supply control unit 103*a* controls to start (soft start) power supply to one of the heating units that is the second heating unit 113, and after 100 milliseconds, start power supply to the other heating unit that is the third heating unit 114. A period between the starts of power supply can be 200 milliseconds or 50 milliseconds instead of 100 milliseconds. In the present embodiment, the second heating unit 113 is first supplied with power; however, the third heating unit 114 can be first supplied with power.

At the temperature detection control timing (3), the temperature of the heating roller 131 detected by the first temperature detecting circuit 119, the temperature of the heating roller 131 detected by the second temperature detecting circuit 120, and the temperature of the pressing roller 125 detected by the third temperature detecting circuit 121 are all lower than the target temperature. Therefore, all the first heating unit 112, the second heating unit 113, and the third heating unit 114 require power supply. At the temperature detection control timing (3), the temperature of the heating roller 131 heated by the first heating unit 112 grouped as the first-priority heating unit is lower than the target temperature. Therefore, power is supplied to the first heating unit 112. The second heating unit 113 and the third heating unit 114 are, however, grouped as the second-priority heating units. Thus, the supply control unit 103*a* selects the second heating unit 113 or the third heating unit 114, and then, supplies power to the selected heating unit. At the temperature detection control timing (3), the difference between the detected temperature of the heating roller 131 and the target temperature is larger than the difference between the detected temperature of the pressing roller 125 and the target temperature. Therefore, the supply control unit 103*a* selects the third heating unit 114, and then, supplies power thereto.

In the present embodiment, to suppress the flicker caused by supplying power to two heating units in the same control cycle, the supply control unit 103*a* controls to start (soft start) power supply to one of the heating units that is the first heating unit 112, and after 100 milliseconds, start power supply to the other heating unit that is the third heating unit 114. A period between the starts of power supply can be 200 milliseconds or 50 milliseconds, instead of 100 milliseconds. In the present embodiment, the first heating unit 112 is first supplied with power; however, the third heating unit 114 can be first supplied with power.

At the temperature detection control timing (4), the temperature of the heating roller 131 detected by the first temperature detecting circuit 119, the temperature of the heating roller 131 detected by the second temperature detecting circuit 120, and the temperature of the pressing roller 125 detected by the third temperature detecting circuit 121 are lower than the target temperature. Therefore, all the first heating unit 112, the second heating unit 113, and the third heating unit 114 require power supply. At the temperature detection control timing (4), the temperature of the heating roller 131 heated by the first heating unit 112 grouped as a first-priority heating unit is lower than the target temperature. Therefore, power is supplied to the first heating unit 112. The second heating unit 113 and the third heating unit 114 are, however, grouped as second-priority heating units. Therefore, the supply control unit 103*a* selects the second heating unit 113 or the third heating unit 114, and then, supplies power to the selected heating unit. At the temperature detection control timing (4), the difference between the detected temperature of the heating roller 131 and the target temperature and the difference between the detected temperature of the pressing roller 125 and the target temperature are equal. Therefore, the supply control unit 103*a* compares the switch off period of the second heating unit 113 with the switch off period of the third heating unit 114, and selects the second heating unit 113 having a longer switch off period. Then, the supply control unit 103*a* supplies power thereto.

In the present embodiment, to suppress the flicker caused by supplying power to two heating units in the same control cycle, the supply control unit 103*a* controls to start (soft start) power supply to one of the heating units that is the first heating unit 112, and after 100 milliseconds, start power supply to the other heating unit that is the second heating unit 113. A period between the starts of power supply can be 200 milliseconds or 50 milliseconds, instead of 100 milliseconds. In the present embodiment, the first heating unit 112 is first supplied with power; however, the second heating unit 113 can be first supplied with power.

Thus, when power is not supplied to a first-priority heating unit, power can be supplied to another second-priority heating unit. Even then, the number of the heating unit to which power is supplied can be at most two. Therefore, the flicker can be suppressed depending on the power capacity and the current consumption of the heating units. In the process according to the present modification, the number of heating unit grouped as a first-priority heating unit is one or more.

The process according to the present modification can be applied to a case in which there are four heating units. More specifically, it is assumed that there are two first-priority heating units and two second-priority heating units in a particular operation mode. If power is not supplied to any one of the two first-priority heating units or if power is supplied to only one of the two first-priority heating units, power is supplied to the two second-priority heating units. If there are one first-priority heating unit and three second-priority heating units in a particular operation mode and power is not supplied to the first-priority heating unit, power can be supplied to at most two second-priority heating units during the same control period.

Figure 17A:
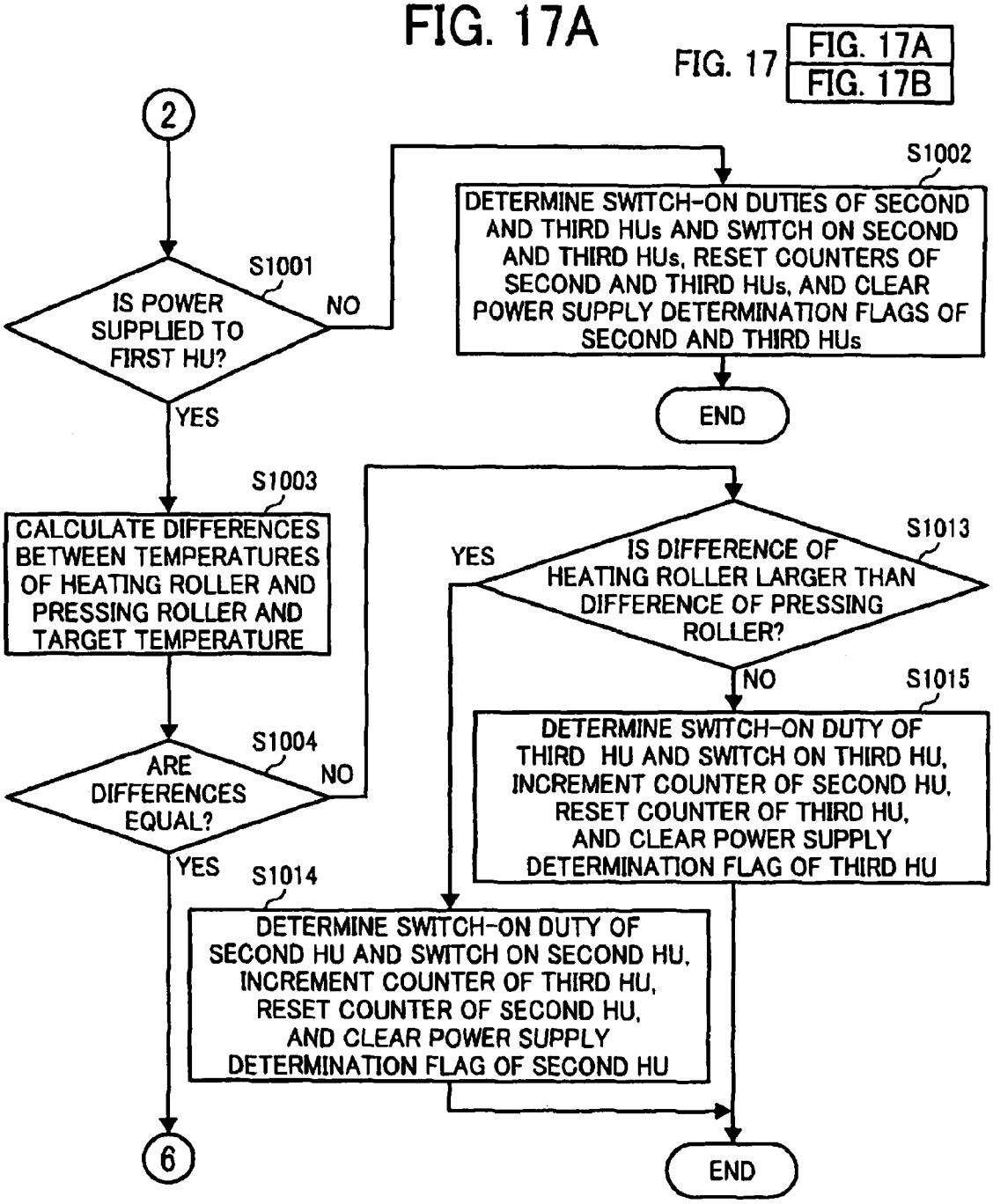
FIG. 17 is a flowchart of procedures for selecting a heating unit to which power is supplied among the heating units grouped as second-priority heating units.
Figure 17B:
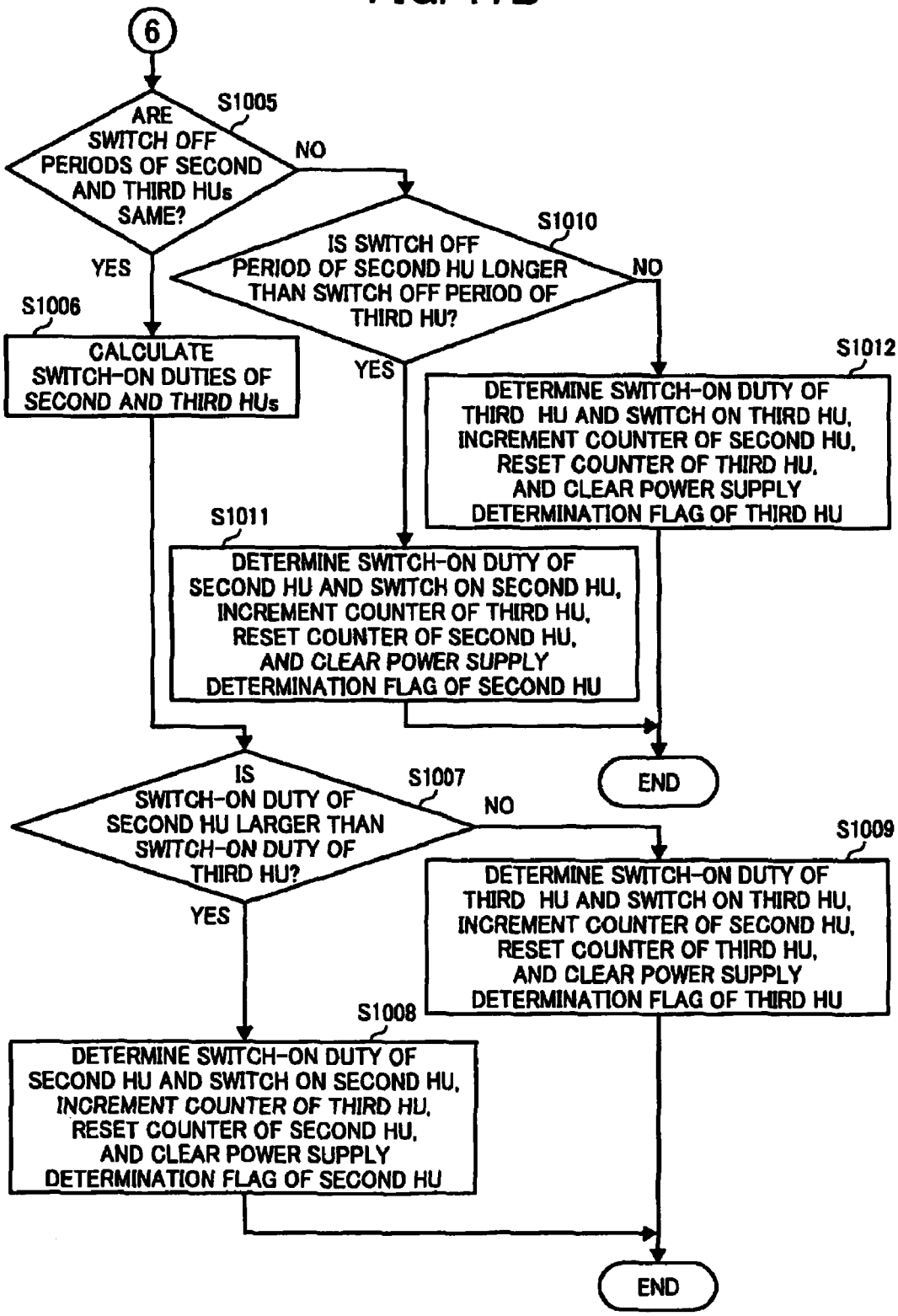

FIG. 17 is a flowchart of procedures for selecting a heating unit to which power is supplied among the heating units grouped as second-priority heating units.

A process to be performed at Step S1003 and thereafter is similar to the process shown in FIG. 10 and described similarly below. The supply control unit 103*a* determines if power is supplied to the first heating unit 112 grouped as a first-priority heating unit (Step S1001). If it is determined that power is supplied to the first heating unit 112 (Yes at Step S1001), the system control proceeds to Step S1003 and thereafter.

The supply control unit 103*a* calculates the difference between the detected temperature of the heating roller 131 and the target temperature and the difference between the detected temperatures of the pressing roller 125 and the target temperature (Step S1003). It is applicable that the differences between the detected temperatures of the heating target members and the target temperature is multiplied with a factor. The supply control unit 103*a* determines if the difference between the detected temperatures of the heating roller 131 and the target temperature and the difference between the detected temperatures of the pressing roller 125 and the target temperature are equal (Step S1004).

A process to be performed when it is determined that the difference between the detected temperatures of the heating roller 131 and the target temperature and the difference between the detected temperatures of the pressing roller 125 and the target temperature are not equal (No at Step S1004) is described in detail below. First, the supply control unit 103*a* determines if the difference between the detected temperatures of the heating roller 131 and the target temperature is larger than the difference between the detected temperatures of the pressing roller 125 and the target temperature (Step S1002).

If it is determined that the difference between the detected temperatures of the heating roller 131 and the target temperature is larger than the difference between the detected temperatures of the pressing roller 125 and the target temperature (Yes at Step S1013), the supply control unit 103*a* performs the same process performed at Step S507 described above (Step S1014).

On the other hand, if it is determined that the difference between the detected temperatures of the heating roller 131 and the target temperature is smaller than or equal to the difference between the detected temperatures of the pressing roller 125 and the target temperature (No at Step S1013), the supply control unit 103*a* performs the same process performed at Step S509 described above (Step S1015).

A process to be performed when it is determined that the difference between the detected temperatures of the heating roller 131 and the target temperature and the difference between the detected temperatures of the pressing roller 125 and the target temperature are equal (Yes at Step S1004) is described in greater below. First, the supply control unit 103*a* determines if the switch off period of the second heating unit 113 and the switch off period of the third heating unit 114 are the same (Step S1005).

If it is determined that the switch off period of the second heating unit 113 and the switch off period of the third heating unit 114 are not the same (No at Step S 1005), the supply control unit 103*a* determines if the switch off period of the second heating unit 113 is longer than the switch off period of the third heating unit 114 (Step S1010). If it is determined that the switch off period of the second heating unit 113 is longer than the switch off period of the third heating unit 114 (Yes at Step S 1010), the supply control unit 103*a* performs the same process performed at Step 5507 described above (Step S1011).

On the other hand, if it is determined that the switch off period of the second heating unit 113 is shorter than or equal to the switch off period of the third heating unit 114 (No at Step S 1010), the supply control unit 103*a* performs the same process performed at Step 5509 described above (Step S1012).

If it is determined that the switch off period of the second heating unit 113 and the switch off period of the third heating unit 114 are the same (Yes at Step S1005), the supply control unit 103*a* determines (or calculates) the switch-on duties of the second heating unit 113 and the third heating unit 114 associated respectively with the difference between the detected temperatures of the heating roller 131 and the target temperature and the difference between the detected temperatures of the pressing roller 125 and the target temperature in the temperature table (Step S1006). Then, the supply control unit 103*a* determines if the switch-on duty of the second heating unit 113 is larger than the switch-on duty of the third heating unit 114 (Step S1007).

If it is determined that the switch-on duty of the second heating unit 113 is larger than the switch-on duty of the third heating unit 114 (Yes at Step S1007), the supply control unit 103*a* performs the same process performed at Step 5507 described above (Step S1008).

On the other hand, if it is determined that the switch-on duty of the second heating unit 113 is smaller than or equal to the switch-on duty of the third heating unit 114 (No at Step S1007), the supply control unit 103*a* performs the same process performed at Step S509 described above (Step S1009).

On the other hand, if it is determined that power is supplied to the first heating unit 112 (No at Step S1001), the supply control unit 103*a* determines switch-on duties that are associated respectively with the difference between the temperature of the heating roller 131 detected by the second temperature detecting circuit 120 and the target temperature and with the difference between the temperature of the pressing roller 125 detected by the third temperature detecting circuit 121 and the target temperature in the temperature table, and then, outputs the power supply signals to the second voltage supply circuit 116 and the third voltage supply circuit 117 according to the determined switch-on duties. The supply control unit 103*a* resets the switch off period counters of the second heating unit 113 and the third heating unit 114, and clears the power supply determination flags set in the second heating unit 113 and the third heating unit 114 (Step S1002).

Thus, according to the present modification, a plurality of heating units can be selected among the heating units grouped as second-priority heating units, and then, power can be supplied thereto, depending on the status of power supply to a heating unit grouped as the first-priority heating unit. Thus, the number of heating unit to which power is supplied can be at most two. As a result, the flicker can be suppressed.

In the first embodiment, the fixing device having three heating units is described. The present invention can, however, be applied to a fixing device having four or more heating units. In a second embodiment of the present invention, a fixing device 1200 having four heating units is described. Description of the configuration similar to the first embodiment is omitted below.

Figure 18:
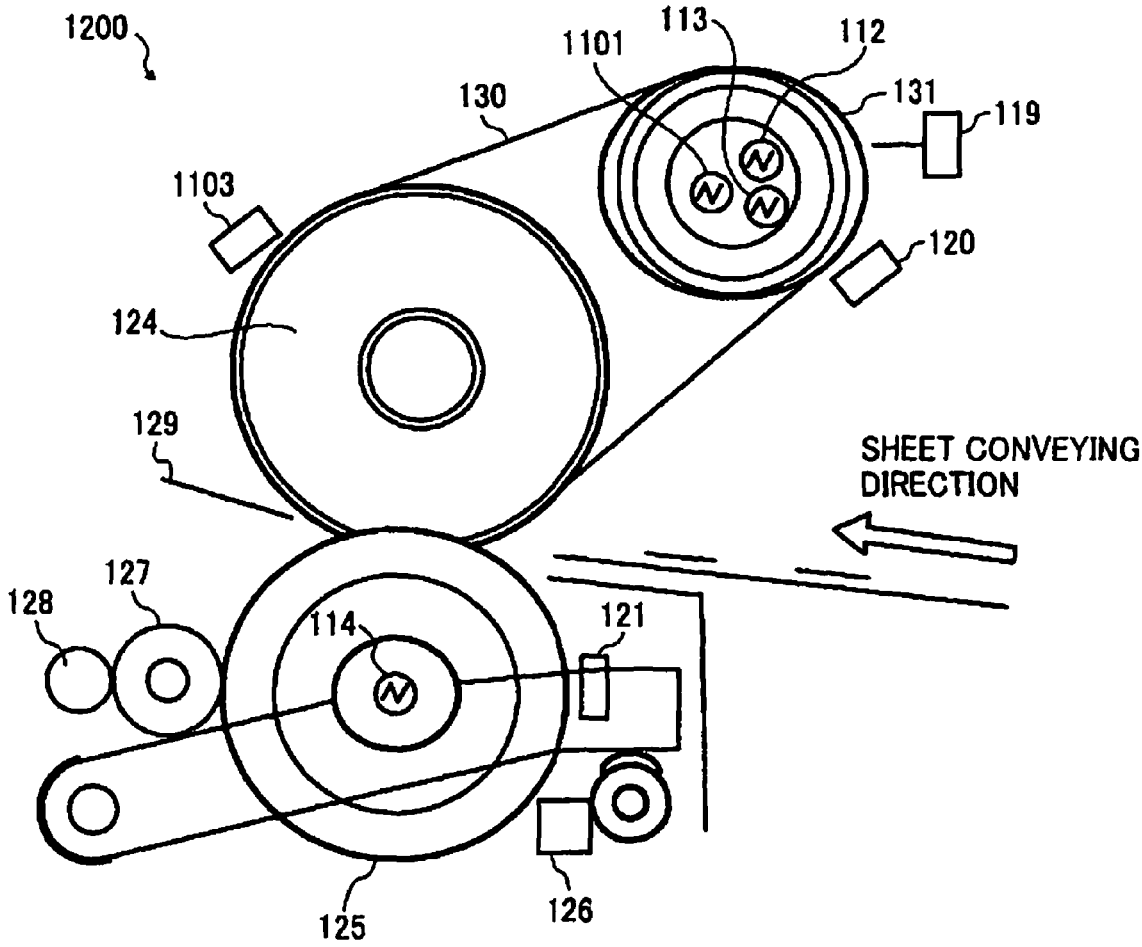
FIG. 18 is a schematic diagram for explaining a configuration example of a fixing device according to a second embodiment of the present invention.
Figure 19:
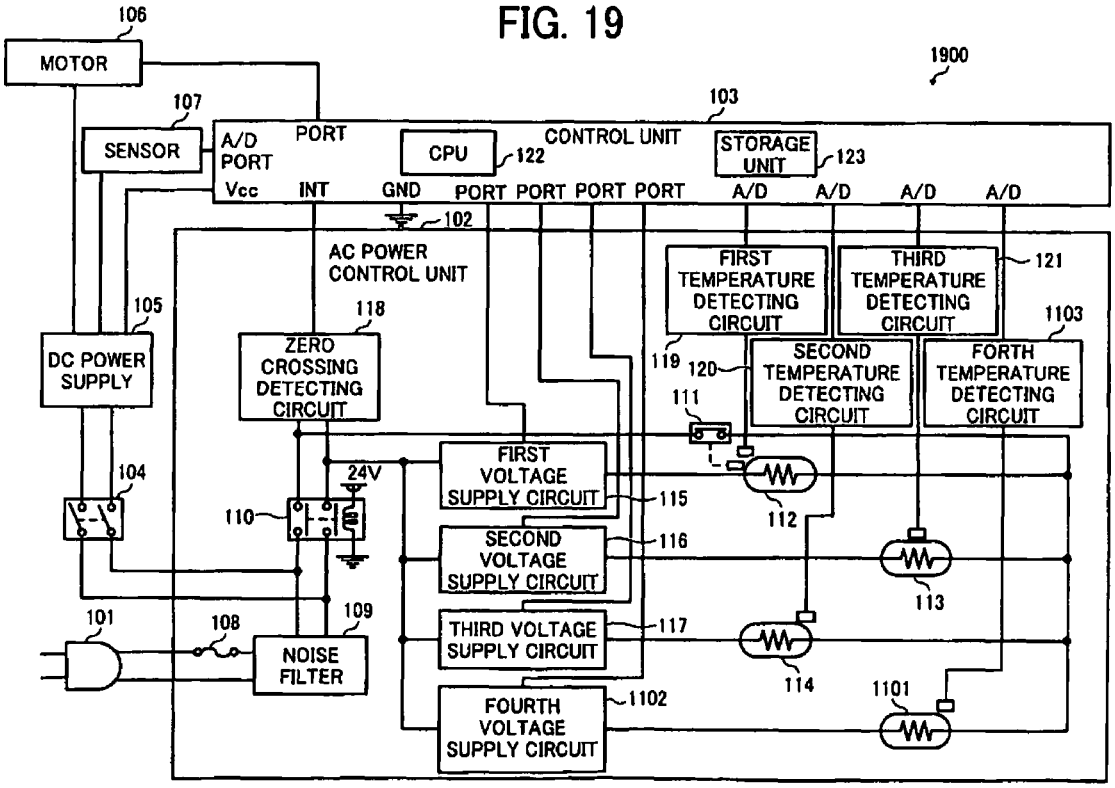
FIG. 19 is a block diagram of a control system mainly for the fixing device according to the second embodiment.

FIG. 18 is a schematic diagram of a configuration example of the fixing device 1200 according to the second embodiment of the present invention. FIG. 19 is a block diagram of a control system mainly for the fixing device 1200. As shown in FIG. 18, the fixing device 1200 is different from the fixing device 221 shown in FIG. 2 in that a fourth heating unit 1101 and a fourth temperature detecting circuit 1103 that is in contact with the surface of the fixing roller 124 and that includes a thermistor that detects a surface temperature of the fixing roller 124 are additionally provided with the fixing device 1200. As shown in FIG. 19, a control system 1900 according to the second embodiment is different from the control system 100 shown in FIG. 3 in that a fourth voltage supply circuit 1102 that supplies power to the fourth heating unit 1101 according to the power supply signal output by the control unit 103 is further provided with the control system 1900 in addition to the fourth heating unit 1101 and the fourth temperature detecting circuit 1103 described above. In the present embodiment also, it is assumed that a halogen heater is used as a heating unit, similarly to the first embodiment. A process for selecting a heating unit performed by the supply control unit 103*a* is generally similar to that in the first embodiment. Therefore, description thereabout is omitted here.

According to the present embodiment, even if the fixing device 1200 includes four heating units, power can be supplied only to one of the heating units grouped as second-priority heating units. Thus, fluctuation of power supply voltage due to supplying power to the heating unit can be suppressed. Therefore, the flicker can be suppressed.

In the above embodiments, an example in which a halogen heater is used as the heating unit for the heating target member is described. Other heating units also can be used for heating the heating target member. In a third embodiment, an induction heating (IH) type heater is used as a first heating unit 1301 for the heating roller 131. Description of the configuration of the MFP 200 according to the first or the second embodiment is omitted.

Figure 20:
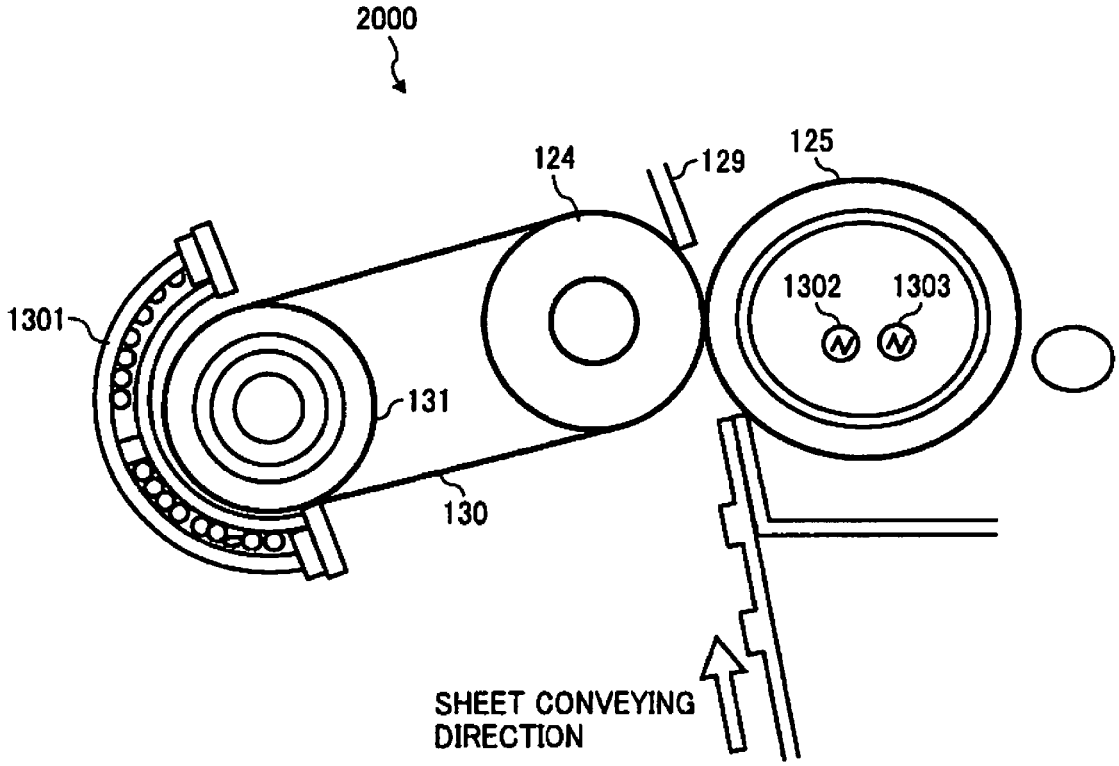
FIG. 20 is a schematic diagram for explaining a configuration example of a fixing device according to a third embodiment of the present invention.

FIG. 20 is a schematic diagram for explaining a configuration example of a fixing device 2000 according to the third embodiment of the present invention. The fixing device 2000 according to the third embodiment is different from the fixing device according to the first or the second embodiment in that an IH type heater is used as the first heating unit 1301 for the heating roller 131 and that a second heating unit 1302 and a third heating unit 1303 that are halogen heaters heat the pressing roller 125. If an IH type heater is used therein, the IH fixing type heater is grouped as a first-priority heating unit regardless of an operation mode.

Thus, a halogen heater that causes large voltage fluctuation at the time of, for example, turning on the heater can be grouped as a second-priority heating unit. Therefore, the flicker can be suppressed while voltage fluctuation caused by a halogen heater can be prevented.

A computer program that is executed by the control unit 103 according to any one of the embodiments is provided by embedded in a ROM, for example. A computer program that is executed by the control unit 103 can, however, be provided by being recorded in a computer readable recording medium such as a compact disc read only memory (CD-ROM), a flexible disk (FD), a compact disc recordable (CD-R), and a digital versatile disk (DVD), for example, in a file in an installable format or in an executable format.

Alternatively, the computer program executed by the control unit 103 according to any one of the embodiments can be configured so that the computer program is stored in a computer connected to a network such as the Internet, and can be provided by downloading it via the network. The computer program executed by the control unit 103 according to any one of the embodiments can be configured to be provided or distributed via a network such as the Internet.

The computer program executed by the control unit 103 according to the any one of the embodiments has a module configuration implementing the function of the supply control unit described above. In an actual hardware, the CPU 122 (i.e., a processor) reads the program from the ROM and executes it. Thus, the various component described above can be loaded on the main memory, and the supply control unit can be generated on the main memory.

The present invention is not limited to the embodiments described above. When embodying the present invention, the various components can be modified without departing from the spirit of the present invention. By combination of a plurality of components disclosed in the embodiment described above, various inventions can be formed. For example, some of the component can be deleted from the whole components disclosed in the embodiments. Further, components disclosed in different embodiments can be combined optionally.

According to an aspect of the present invention, the tendency of the heating units repeating the cycle of switching on and off can be prevented. As a result, the flicker can be suppressed advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing unit that fixes a toner image transferred onto a recording medium by a heating target unit heated by a plurality of heating units each of which is grouped as a first heating unit to which power is selectively supplied or a second heating unit to which power is supplied in priority to the first heating unit;

a detecting unit that is provided to each of the heating units, and detects a temperature of the heating target unit heated by the heating units; and a supply control unit that supplies power to a heating unit grouped as the second heating unit and selectively supplies power to a heating unit grouped as the first heating unit, among the heating units that heat the heating target unit of which detected temperature is lower than a target temperature, wherein the supply control unit selectively supplies power to the heating units grouped as the first heating unit based on any one of a first supply condition about comparative relationship of differences between the detected temperature and the target temperature, a second supply condition about comparative relationship of periods during which power is not supplied to the heating units, and a third supply condition about comparative relationship of power supply periods based on the detected temperature.

2. The fixing device according to claim 1, wherein the supply control unit selects one heating unit among the heating units grouped as the first heating unit and supplies power to selected heating unit.

3. The fixing device according to claim 1, wherein the supply control unit selectively supplies power to the heating units grouped as the first heating unit based on the second supply condition having a second biggest urgency if the supply control unit cannot select the heating units based on the first supply condition having a biggest urgency, and selectively supplies power to the heating units grouped as the first heating unit based on the third supply condition if the supply control unit cannot select the heating units based on the second supply condition.

4. The fixing device according to claim 1, wherein the second condition is a comparative relationship of periods during which power is not supplied to the heating units while the heating units are grouped as the first heating unit.

5. The fixing device according to claim 1, wherein the heating units grouped as the first heating unit are halogen heaters.

6. The fixing device according to claim 1, wherein the supply control unit determines if the detected temperature is lower than the target temperature every predetermined cycle, and supplies power to the heating unit grouped as the second heating unit and selectively supplies power to the heating units grouped as the first heating unit among the heating units that heat the heating target unit of which detected temperature is determined to be lower than the target temperature.

7. An image forming apparatus comprising:

a fixing unit that fixes a toner image transferred onto a recording medium by a heating target unit heated by a plurality of heating units each of which is grouped as a first heating unit to which power is selectively supplied or a second heating unit to which power is supplied in priority to the first heating unit;

a detecting unit that is provided to each of the heating units, and detects a temperature of the heating target unit heated by the heating units; and a supply control unit that supplies power to a heating unit grouped as the second heating unit and selectively supplies power to a heating unit grouped as the first heating unit, among the heating units that heat the heating target unit of which detected temperature is lower than a target temperature, wherein the supply control unit selectively supplies power to the heating units grouped as the first heating unit based on any one of a first supply condition about comparative relationship of differences between the detected temperature and the target temperature, a second supply condition about comparative relationship of periods during which power is not supplied to the heating units, and a third supply condition about comparative relationship of power supply periods based on the detected temperature.

8. The image forming apparatus according to claim 7, wherein the supply control unit selects one heating unit among the heating units grouped as the first heating unit and supplies power to selected heating unit.

9. The image forming apparatus according to claim 7, wherein each of the heating units is differently grouped as the first heating unit or the second heating unit for each operating state of the image forming apparatus.

10. The image forming apparatus according to claim 7, wherein the supply control unit selectively supplies power to the heating units grouped as the first heating unit based on the second supply condition having a second biggest urgency if the supply control unit cannot select the heating units based on the first supply condition having a biggest urgency, and selectively supplies power to the heating units grouped as the first heating unit based on the third supply condition if the supply control unit cannot select the heating units based on the second supply condition.

11. The image forming apparatus according to claim 7, wherein the second condition is a comparative relationship of periods during which power is not supplied to the heating units while the heating units are grouped as the first heating unit.

12. The image forming apparatus according to claim 7, wherein the heating units grouped as the first heating unit are halogen heaters.

13. The image forming apparatus according to claim 7, wherein the supply control unit selectively supplies power to the heating units grouped as the first heating unit if the image forming apparatus is set in a mode in which voltage fluctuation caused by supplying power to the heating units is suppressed.

14. The image forming apparatus according to claim 7, wherein the supply control unit determines if the detected temperature is lower than the target temperature every predetermined cycle, and supplies power to the heating unit grouped as the second heating unit and selectively supplies power to the heating units grouped as the first heating unit among the heating units that heat the heating target unit of which detected temperature is determined to be lower than the target temperature.

15. A method of controlling a fixing device, the method comprising:

fixing a toner image transferred onto a recording medium by a heating target unit heated by a plurality of heating units each of which is grouped as a first heating unit to which power is selectively supplied or a second heating unit to which power is supplied in priority to the first heating unit;

detecting a temperature of the heating target unit heated by the heating units; and supplying power to a heating unit grouped as the second heating unit and selectively supplies power to a heating unit grouped as the first heating unit, among the heating units that heat the heating target unit of which detected temperature is lower than a target temperature, wherein the supply control unit selectively supplies power to the heating units grouped as the first heating unit based on any one of a first supply condition about comparative relationship of differences between the detected temperature and the target temperature, a second supply condition about comparative relationship of periods during which power is not supplied to the heating units, and a third supply condition about comparative relationship of power supply periods based on the detected temperature.

* * * * *